US010139058B2

(12) United States Patent
Santiago

(10) Patent No.: US 10,139,058 B2
(45) Date of Patent: Nov. 27, 2018

(54) ORNAMENT WITH BACKLIT FILM IMAGE

(71) Applicant: Robert L. Santiago, Hilo, HI (US)

(72) Inventor: Robert L. Santiago, Hilo, HI (US)

( * ) Notice: Subject to any disclaimer, the term of this patent is extended or adjusted under 35 U.S.C. 154(b) by 57 days.

(21) Appl. No.: 15/295,871

(22) Filed: Oct. 17, 2016

(65) Prior Publication Data

US 2017/0027361 A1 Feb. 2, 2017

Related U.S. Application Data

(63) Continuation-in-part of application No. 14/868,269, filed on Sep. 28, 2015, now Pat. No. 9,470,392, which
(Continued)

(51) Int. Cl.
*A47G 33/08* (2006.01)
*F21V 3/02* (2006.01)
(Continued)

(52) U.S. Cl.
CPC ..... *F21S 4/10* (2016.01); *A47G 33/0836* (2013.01); *F21V 1/04* (2013.01); *F21V 1/143* (2013.01); *F21V 1/22* (2013.01); *F21V 3/02* (2013.01); *F21V 7/045* (2013.01); *G09F 13/0413* (2013.01); *A47G 2033/0827* (2013.01); *F21L 4/08* (2013.01); *F21V 7/04* (2013.01); *F21V 17/104* (2013.01); *F21V 17/164* (2013.01); *F21V 19/006* (2013.01); *F21V 29/83* (2015.01);
(Continued)

(58) Field of Classification Search
CPC ..... G09F 11/02; G09F 11/025; G09F 11/23; G09F 13/04; G09F 13/0404; G09F 13/0409; G09F 13/0413; G09F 7/22; G09F 15/0081; F21V 1/22; F21V 3/02; F21V 3/04; F21V 3/049; F21V 3/0472; F21V 1/02; F21V 1/04; F21V 1/143
See application file for complete search history.

(56) References Cited

U.S. PATENT DOCUMENTS 986,590 A 3/1911 Persons
1,000,231 A 8/1911 Bowles
(Continued)

OTHER PUBLICATIONS

The Crystal Reference Encyclopedia, "Refraction", 2005, Crystal Semantics Limited, 2 pages.

*Primary Examiner* — Alan B Cariaso
(74) *Attorney, Agent, or Firm* — Lowry Blixseth LLP; Scott M. Lowry

(57) ABSTRACT

An ornament with a backlit film image having a curved substrate with a smooth surface and an at least partially transparent portion viewable therethrough when backlit. The backlit film image includes a flat top surface and a flat bottom surface, wherein one of the flat top surface or the flat bottom surface is positioned flush against the smooth surface of the curved substrate when the backlit film image is removably coupled thereto. A first end cap and a second end cap are configured to receive and retain a portion of the substrate such that the first and second end caps and the substrate support one another into a substantially upright position to define an enclosure. An insert removably engages one of the first or second end caps and includes an aperture having a size and shape for compression-fit engagement with a light source.

32 Claims, 24 Drawing Sheets

Related U.S. Application Data is a continuation-in-part of application No. 13/248,646, filed on Sep. 29, 2011, now Pat. No. 9,146,010.

(60) Provisional application No. 61/393,227, filed on Oct. 14, 2010, provisional application No. 61/388,897, filed on Oct. 1, 2010.

(51) Int. Cl.

| | |
|---|---|
| ***F21V 1/04*** | (2006.01) |
| ***F21S 4/10*** | (2016.01) |
| ***F21V 1/14*** | (2006.01) |
| ***F21V 1/22*** | (2006.01) |
| ***F21V 7/04*** | (2006.01) |
| ***G09F 13/04*** | (2006.01) |
| *F21V 19/00* | (2006.01) |
| *F21V 17/16* | (2006.01) |
| *F21V 17/10* | (2006.01) |
| *F21V 29/83* | (2015.01) |
| *F21L 4/08* | (2006.01) |
| *F21W 121/04* | (2006.01) |
| *F21W 121/00* | (2006.01) |

(52) U.S. Cl.

CPC ..... *F21W 2121/00* (2013.01); *F21W 2121/04* (2013.01); *G09F 2013/0481* (2013.01)

(56) References Cited

U.S. PATENT DOCUMENTS

| | | | | |
|---|---|---|---|---|
| 1,180,138 | A | | 4/1916 | Giese |
| 1,592,595 | A | | 7/1926 | Arendt |
| 1,663,386 | A | | 3/1928 | Rice |
| 2,339,385 | A | | 1/1944 | Dupler |
| 2,772,494 | A | * | 12/1956 | Bishop ..... G09F 13/0413 40/605 |
| 2,881,306 | A | * | 4/1959 | Sherron ..... E04H 1/14 250/200 |
| 3,109,252 | A | | 11/1963 | Schellenberg |
| 3,390,259 | A | * | 6/1968 | Angier ..... F21S 8/088 362/812 |
| 3,587,185 | A | | 6/1971 | Deal |
| 3,764,801 | A | | 10/1973 | Mainieks |
| 4,196,535 | A | | 4/1980 | Helmo |
| 4,290,096 | A | | 9/1981 | Szpur |
| 4,953,067 | A | | 8/1990 | Moore |
| 5,184,890 | A | | 2/1993 | Chen et al. |
| 5,513,084 | A | | 4/1996 | Simpson |
| 5,609,411 | A | | 3/1997 | Wang et al. |
| 5,685,635 | A | | 11/1997 | Barthelmess |
| 5,809,679 | A | | 9/1998 | Arjmand |
| 5,911,501 | A | | 6/1999 | Katz |
| 6,010,236 | A | | 1/2000 | Lai |
| 6,282,825 | B1 | | 9/2001 | Godfrey et al. |
| 6,572,247 | B2 | | 6/2003 | Liu |
| 7,946,735 | B2 | | 5/2011 | Chou et al. |
| 2009/0323315 | A1 | | 12/2009 | Tuite et al. |
| 2011/0233593 | A1 | | 9/2011 | Kawagoe et al. |

* cited by examiner

ORNAMENT WITH BACKLIT FILM IMAGE

BACKGROUND OF THE INVENTION

This invention relates generally to an ornament including backlit film bearing a custom image formed into a generally cylindrical shape and retained in the form of a hollow cylinder by circular upper and lower retainer caps. At least one of these retainer caps, such as the upper cap, has a small opening formed therein to receive a light source, such as a light mounted along an elongated strand of the type used for Christmas decorations.

Backlit film is generally known in the art for use in printing a custom image onto the film, and then backlighting the printed film to illuminate the custom image. Such backlit film is often used in the preparation of posters and the like of generally planar shape. Backlit film has recently become available for use in home printing applications, such as by use of an inkjet printer or the like for printing of a wide variety of home artwork, such as individual photographs of friends and relatives. Exemplary backlit film is commercially available in rolls of different sheet lengths suitable for use with wide format inkjet media from Eastman Kodak Company, Rochester, N.Y., under the brand name Kodak Premium Backlit Film, or from Hewlett-Packard Development Company of Houston, Tex., under the brand name HP Premium Vivid Color Backlit Film.

The prior art discloses several different types of ornaments that use light to illuminate an image or sign, but such devices tend to be overly complex and expensive to manufacture, which can significantly inhibit commercial viability. Moreover, none of these prior art devices incorporate a backlit film image in the manner disclosed herein, and as briefly mentioned above. For example, U.S. Pat. No. 3,587,185 to Deal discloses an omni-directional sign that includes a refracting cylinder having a light source disposed therein. The cylinder includes a series of individual refracting rings, wherein each ring, in turn, consists of a large number of individual refracting elements. These refracting elements are grouped together in identical sequences equally spaced around the periphery of the cylindrical element. These refracting elements or sidewall corrugations of the refracting cylinder are shown generally with respect to the cross-sectional views of FIGS. 1-2 and 17-18. Accordingly, the cylinder wall includes a first set of surfaces radial to the cylinder, and a second set of surfaces which are opaque to prevent light from passing through to the cylinder. An imprinting roller may press-fit these corrugations (e.g., the refracting, radial or opaque surfaces) to the surface of the cylinder by hot pressing it against a second, smooth roller. Then, the opaque surfaces, which stand out from the refracting or radial surfaces, are painted by a second similar set of rollers. Such corrugation results in several different surfaces oriented at angles relative to one another, including a jagged surface characterized by numerous peaks and valleys. Deal discloses a variety of these repeating refracting surface arrangements, some of which involve complex combinations of radial, tangential, and angled surfaces, all of which are jagged, as shown, e.g., in FIGS. 4, 4*a*, 5 and 7. As a result of the un-even alternating surface structure formed as part of the refracting surfaces of the cylinder, Deal requires the opaque surfaces to prevent light scattering. In this respect, a portion of the refracting surfaces are either painted black, as mentioned above, to absorb the light or painted silver to reflect the light. These opaque surfaces inhibit full and even illumination of substantially the entire surface area of the backlit image, especially since the backlit image cannot sit flush with substantially the entire surface area of the cylinder because of the many corrugations which create outwardly extending "peak" sections, which sometimes form only a single point of contact for the backlit image, e.g., as shown in FIGS. 4 and 4*a*, and the corresponding depressed "valley" sections. This corrugated structure has a specific purpose, when combined with a single smooth cylindrical surface, to create prismatic refracting elements that permit variations in the displayed image, depending on the angular viewing position relative to the omni-directional sign. While this may be desired for the image disclosed in Deal, it is particularly undesirable for full and even illumination of a backlit film image not meant to be distorted depending on the viewing angle.

In another example, U.S. Pat. No. 5,513,084 to Simpson discloses a holiday lighting decoration and method for using the same. More specifically, the Simpson device includes a motor driven carousel that displays a series of images on a transparent material. A hollow transparent support provides an upright receptacle for retention of photographs within the carousel for rotation therewith for sequentially displaying images on the transparent material by way of being illuminated by a centrally located light bulb. One problem with Simpson is that the carousel design is overly complex, namely it requires an electric motor, three separate gear assemblies (e.g., a worm drive, idler gear, and 360 degree rotational gear), related axles, linkages, fasteners, rotational friction bearings, etc. In all, the Simpson device requires a dozen or more precision interlocking mechanical parts when fully assembled. The reinforced housing carrying the mechanical elements also carries the centrally disposed lamp post relative thereto about a bearing in the form of a plastic washer. This allows the gear assembly to turn the transparent support carrying the images, relative to the upstanding light without actually turning the light. This is necessary to avoid twisting the line that provides power to the light. As such, the transparent support must rotate about the washer relative to the insert supporting the light otherwise the Simpson device will not work. As a result, the Simpson device must be hung from a hook that similarly permits rotation relative thereto, otherwise the hook itself would bind during rotation of the lighting decoration. This undesirably precludes hanging the Simpson device from a lighting structure having power lines extending therefrom.

In another reference, U.S. Patent No. to Bowles discloses a lamp-box having a shell that encloses a plurality of lamps for illuminating flat negatives for retouching thereof. The front of the shell resides in a single plane and provides an opening for slide-in reception of a negative. A set of guideways permit insertion/removal of the negative into and out from the lamp box. In this respect, FIGS. 1-4 illustrate that the front of the lamp-box is planar or flat and would otherwise prohibit insertion of a curved backlit film image. This is important because the very purpose of the Bowles invention is to provide a simple and inexpensive box adapted for photographic work. In this respect, the negative, picture or other object may be modified while being illuminated by a light source inside. Accordingly, a negative is placed in the slide plate and in a flat position favorable for retouching. Such a planar structure prohibits three-dimensional viewing of the image around the entire exterior of the lamp box. Rather, one must sit directly in front of, and preferably perpendicular to, the plane of the negative.

In another example, U.S. Pat. No. 1,663,386 to Rice discloses illumination of a sign for "The DOE Co." that adheres directed to a substrate or sheet to form a single sheet of flexible material of uniform thickness. The two sheets are, therefore, inseparable. Such permanent affixation is particularly undesirable because the sign cannot be removed and replaced by other signage without completely replacing the entire unit (i.e., both the sign and the supporting substrate or sheet mentioned above). More specifically, Rice discloses a transparent sign constructed from two pieces of flexible transparent sheets, one sheet that includes a painted surface (e.g., with "The DOE Co." thereon) and a second support sheet. The adjacent sheets are then treated with a chemical that causes the adjacent surfaces of the sheets to adhere to one another and knit together to form a single sheet of flexible material. Chemically bonding the sheets together to form a single sheet of material is undesired because it is not possible to remove and replace for purposes of interchanging the image. The stated purpose of such chemical adhesion as disclosed by Rice is to protect the painted sheet from the weather. For example, water cannot contact the painted surface because it is inseparably bonded into a single, individual piece of material. If the two surfaces were separable, weather and moisture would be allowed to contact the printed advertising material and could cause premature wear.

In another reference, U.S. Pat. No. 3,764,801 to Mainieks discloses a knock-down kit for forming a lamp shade. In general, the lamp shade has a generally circular side wall having an upper rim that selectively receives and retains a U-shaped upper hoop and a lower rim that selectively receives and retains a U-shaped lower hoop. The U-shaped upper and lower hoops attach to the lamp shade side wall by way of a series of elongated rectangular slots formed therein, e.g., as shown with respect to an upper periphery in FIG. 6. Here, the elongated rectangular slots are configured to selectively receive and retain respective locking barbs disposed within the U-shaped channel of the upper hoop. Given that the elongated rectangular slots are not edge accessible by way of the upper rim, the locking barbs in the U-shaped channel must flex outwardly to accommodate insertion of the side wall of the lamp shade into the U-shaped channel, then flex inwardly to subsequently retain their original shape such that the locking barbs engage within respective elongated slots. Once engaged, Mainieks states that it is relatively difficult, if not impossible, to remove the upper and/or lower hoops without damaging the lamp shade side wall. Such permanent affixation is undesirable because it prevents subsequent disengagement of the upper and/or lower hoops for purposes of removing and/or replacing a backlit film image. Furthermore, elongated rectangular slots that are not edge accessible are undesirable because they require flexation of the upper and/or lower hoops, which destabilizes the structure relative to one that is rigid.

The present disclosure pertains to a relatively simple and easily constructed ornament having a three-dimensional shape, particularly such as a generally cylindrical shape, wherein backlit film bearing a custom image and formed into the desired size and shape is formed into a hollow cylinder and retained by upper and lower retainer caps, for selected assembly individually or in groups with an elongated light strand having multiple light sources. Each ornament is arranged with one of the light sources positioned therein to backlight the custom film image.

SUMMARY OF THE INVENTION

The ornament with a backlit film image disclosed herein includes a substrate having an at least partially transparent portion viewable therethrough when backlit. A first end cap and a second end cap are configured to receive and retain a portion of the substrate in a substantially closed loop shape such that the first and second end caps and the substrate form an ornament that maintains a substantially upright position defining an enclosure. In this respect, an adhesive may be disposed on a portion of the substrate for retaining overlapping portions of the substrate in the closed loop shape. A light source is disposed within the enclosure and positioned to illuminate the backlit film image at least partially viewable through the transparent portion of the substrate.

In a particularly preferred embodiment, the substrate includes a substantially rigid transparent substrate. Here, the backlit film image may be attached around the outside or tensioned to expand into an inner surface of the transparent substrate for viewing. A plug may be selectively attachable to the first end cap and include an insert for selectively retaining and hanging the light source within the enclosure. In this respect, it may be preferable to include a reflector coupled to the second end cap. A domed reflector is particularly preferred as it can be positioned to reflect light from the light source onto the backlit film image. Doing so provides additional illumination against the image itself instead of allowing the light to potentially escape or dissipate through the ends of the enclosure. The domed reflector, and preferably at least the second end cap, may further include one or more vents to permit convection cooling throughout the enclosure. The vent is particularly useful when used in conjunction with an accompanying vent formed from a portion of the first end cap.

The first and second end caps preferably include a channel configured for slide-fit reception of the substrate. The channels may include a projection configured to selectively engage respective apertures formed in a portion of the substrate. The projections may lock into the apertures by snap-tight or press-fit engagement. The first end cap may further include an insert configured to receive and hang the light source within the enclosure. Such an insert may include an x-slit or a set of flaps formed from a portion of the first end cap. Like the first end cap, the plug may also include one or more vents.

In an alternative embodiment, the substrate may include a translucent pocket defined by a pair of generally overlying films for slidably receiving and supporting the backlit film image. In another alternative embodiment, the backlit film image may be formed from a portion of the substrate. Furthermore, the light source may be coupled to an elongated strand having additional lights coupled thereto, such as a set of Christmas tree lights.

In another embodiment disclosed herein, the ornament with a backlit film image may include a curved substrate having a smooth surface and an at least partially transparent portion viewable therethrough when backlit. The backlit film image may include a flat top surface and a flat bottom surface, wherein one of the flat top surface or the flat bottom surface is positioned flush against the smooth surface of the curved substrate when the backlit film image is removably coupled thereto. A first end cap and a second end cap may be configured to selectively receive and retain at least a portion of the curved substrate. In one embodiment, the first and second end caps and the curved substrate may be supported into a substantially upright position to define an enclosure. Moreover, an insert may removably engage with the first end cap and include an aperture having a size and shape for compression-fit engagement with a light source. When engaged, the light source may be disposed within the enclosure and positioned to illuminate the backlit film image at least partially viewable through the transparent portion of the curved substrate.

In one aspect of this embodiment, the smooth surface includes an inner surface of the curved substrate and the backlit film image is tensioned to expand the flat top surface into engagement with the inner surface. In another aspect of this embodiment, the smooth surface includes an outer surface of the curved substrate and the flat bottom surface of the backlit film image wraps around at least a portion of the outer surface and may be taped or otherwise adhesively attached thereto. The first and second end caps preferably each include a channel configured for slide-fit reception of the curved substrate, wherein each channel may include a projection configured for selective engagement with a respective aperture in the curved substrate for locking engagement therewith. Furthermore, the second end cap may include a vent to permit convection cooling throughout the enclosure and a domed reflector may couple to the second end cap and be positioned to reflect light from the light source onto the backlit film image. Other features of this embodiment may include an ornament with a backlit film image wherein the curved substrate includes a cylindrical substrate, the insert is a compressible rubber insert, and the light source may be coupled to an elongated strand including a plurality of light sources coupled thereto.

In another embodiment, the ornament with a backlit film image as disclosed herein may include a substantially rigid and transparent substrate having a smooth inner surface and an at least partially transparent portion viewable therethrough when backlit. The transparent substrate may further include a translucent pocket defined by a pair of generally overlying films for slidably receiving and supporting the backlit film image. A curved backlit film image having a flat surface may be positioned adjacent the smooth inner surface of the transparent substrate when the curved backlit film image is removably coupled thereto. Here, the curved backlit film image may be tensioned so substantially the entire surface area of the flat surface expands into engagement with the smooth inner surface of the transparent substrate.

In this embodiment, a first end cap and a second end cap may be configured to selectively receive and retain a portion of the transparent substrate in a substantially closed loop shape, wherein the first and second end caps and the transparent substrate are supported into a substantially upright position to define an enclosure. One of the first or the second end caps may include a vent to permit convection cooling throughout the enclosure. Additionally, the first and second end caps may each include a channel configured for slide-fit reception of the transparent substrate, wherein each channel includes a projection configured for selective engagement with a respective aperture in the transparent substrate for locking engagement therewith. In another aspect of this embodiment, an insert may be removably engaged with one of the first or second end caps and may include an aperture having a size and shape for compression-fit engagement with a light source. When engaged, the light source may be disposed within the enclosure and positioned to illuminate the backlit film image at least partially viewable through the transparent portion of the substrate. To this end, a plurality of ornaments may each removably couple with a light source coupled to an elongated strand of light sources.

In another embodiment disclosed herein, the ornament with a backlit film image includes a substantially cylindrical substrate having a first smooth surface and a second smooth surface with at least a portion thereof being transparent and viewable therethrough when backlit. The curved backlit film image may include a printable flat top surface and a flat bottom surface tensioned to expand into the first smooth surface of the cylindrical substrate so substantially the entire surface area of the printable flat top surface seats flush against the first smooth surface of the cylindrical substrate. A first end cap and a second end cap each have a respective channel configured for slide-fit reception of the cylindrical substrate in a substantially closed loop shape, wherein the first and second end caps and the transparent substrate are supported into a substantially upright position to define an enclosure. Furthermore, a plurality of projections may be positioned within each respective channel and configured for selective engagement with a respective aperture in the cylindrical substrate for press-fit engagement therewith and a plug may be selectively attachable to the first end cap in non-rotatable relation relative thereto and may include an aperture configured for press-fit engagement with a light source for selectively retaining and hanging the light source within the enclosure, wherein the plug includes a rubber plug having an engagement channel configured for slide-in engagement with the first end cap.

In another embodiment, an ornament as disclosed herein may include a curved substrate having a smooth surface and an at least partially transparent portion viewable therethrough when backlit. The ornament may also include a backlit film image having a flat top surface and a flat bottom surface. One of the flat top surface or the flat bottom surface may be positioned flush against the smooth surface of the curved substrate when the backlit film image is removably coupled thereto. A first end cap and a second end cap may be configured to selectively receive and retain at least a portion of the curved substrate such that the first and second end caps and the curved substrate are supported into a substantially upright position to define an enclosure. Furthermore, an insert may be removably engaged with the first end cap in non-rotatable relation relative thereto and may include an aperture having a size and shape for compression-fit engagement with a light source. When engaged, the light source may be disposed within the enclosure in non-rotatable relation relative to the top end cap and positioned to illuminate the backlit film image at least partially viewable through the transparent portion of the curved substrate.

In one aspect of this embodiment, the first and second end caps may define respective top and bottom ends of the ornament. In this respect, the first and second end caps may each include a channel configured for slide-fit reception of the curved substrate. The channels retain the curved substrate therein by including one or more projections configured for selective engagement with a reciprocal number of detents in the curved substrate, for locking engagement therewith. The light source may be vertically suspended from the top end of the ornament such that the light emitted therefrom may reflect off a domed reflector coupled to the second end cap and positioned to reflect light from the light source onto the backlit film image. The second end cap may further include a vent to permit convection cooling throughout the enclosure, and especially in and around the light source.

In one embodiment, the smooth surface of the curved substrate may include an outer surface of the curved substrate and the flat bottom surface of the backlit film image may wrap around at least a portion of the outer surface thereof. Alternatively, the smooth surface may include an inner surface of the curved substrate and the backlit film image may be tensioned to expand the flat top surface into flush or co-planar engagement with the inner surface. The light source may be coupled to an elongated strand that includes a plurality of light sources coupled thereto and configured for insertion within respective ornaments.

In another embodiment, an ornament as disclosed herein may include a substantially cylindrical substrate having a smooth surface and an at least partially transparent portion viewable therethrough when backlit. A backlit film image having a flat top surface and a flat bottom surface may be positioned so that one of the flat top surface or the flat bottom surface is positioned flush against the smooth surface of the cylindrical substrate when the backlit film image is removably coupled thereto. An end cap having a channel configured to selectively receive and retain at least a portion of the cylindrical substrate may be used in combination with the cylindrical substrate to create a substantially upright ornament having an enclosure. A projection may be positioned within the channel of the end cap and configured for select slide-in engagement with an edge accessible slot formed from the cylindrical substrate for locking engagement of the end cap and the cylindrical substrate.

More specifically, in one embodiment, the edge accessible slot may include a pair of L-shaped slots and the projection may include a pair of projections in the channel of the end cap. Here, the pair of L-shaped slots may have a size and shape for locking engagement with the respective pair of projections. In an alternative embodiment, the edge accessible slot may include a first cutout extending inwardly from an edge of the cylindrical substrate and a second cutout coupled to and extending away from the first cutout and terminating in a seating cutout having a size and shape for select yielding reception and retention of the projection. Here, the first cutout may include a longitudinal cutout substantially parallel to a longitudinal axis of the cylindrical substrate and the second cutout may include a lateral cutout substantially orthogonal to the longitudinal cutout. At least one of the first or second cutouts may be positioned at an angle relative to the edge. The projection and the edge accessible slot permit selective attachment and removal of the end cap with the cylindrical substrate. The channel may include a substantially rigid material that is otherwise substantially incapable of outwardly flexing.

In another aspect of this embodiment, the end cap may include a first end cap having a first channel and a second end cap having a second channel. Here, the first channel may include a pair of projections having a size and shape for respective engagement with a pair of upper edge accessible engagement slots in an upper edge of the cylindrical substrate. Additionally, the second channel may include a similar pair of projections having a size and shape for respective engagement with a pair of lower edge accessible engagement slots in a lower edge of the cylindrical substrate. In one embodiment, the first and second end caps may be interchangeable. One of the first or second end caps may also be configured for removable engagement of an insert in non-rotatable relation relative thereto. The insert may include an aperture having a size and shape for compression-fit engagement with a light source also in non-rotatable relation relative thereto. The other of the first or second end caps may include a vent to permit convection cooling within the ornament. Furthermore, an upper edge and/or a lower edge of the backlit film image may reside within the respective first and second channels of the first and second end caps. In some embodiments, the projections may be positioned approximately halfway down within the channel.

In yet another alternative embodiment, an ornament as disclosed herein may alternatively include a substantially rigid and upright frame generally forming a plurality of open frame sections each having a smooth inner surface and framing a respective viewing region. The ornament may also include at least one transparent outer lens having a smooth outer surface and a smooth inner surface. Here, the smooth outer surface may be positioned flush against the smooth inner surface of one of the open frame sections. Additionally, the ornament may include at least one backlit film image having a flat top surface positioned flush against the smooth inner surface of the at least one transparent outer lens. In this position, the backlit film image may be substantially aligned within the framed viewing region of one of the open frame sections. This permits external viewing of the backlit film image. At least one transparent inner lens may have a smooth outer surface configured for flush engagement with a flat bottom surface of the backlit film image. As such, the ornament may also include at least one retainer cap configured to selectively receive and retain at least a portion of the frame to define an enclosure with the at least one backlit film image positioned therein and viewable within respective viewing region.

In one aspect of this embodiment, the frame may include a prismatic shape formed by interconnection of the plurality of open frame sections. In this respect, a pyramid-shaped reflector may couple to the frame opposite the at least one retainer cap and be positioned to reflect light from a light source onto the backlit film image. The pyramid-shaped reflector may also include a baffle vent and an interior surface coated with a reflective material. The at least one retainer cap may also be formed into a triangular shape.

In an additional embodiment, the at least one transparent outer lens may include multiple transparent outer lenses that interconnect together into a transparent outer lens assembly. Similarly, the at least one backlit film image may include multiple backlit film images that interconnect into a single backlit film image or a backlit film image assembly. Moreover, the at least one transparent inner lens may include multiple transparent inner lenses that separately interconnect into a transparent inner lens assembly. The transparent inner lens assembly may have a size and shape to selectively slide within the transparent outer lens assembly, such that the backlit film image or backlit film image assembly is sandwiched in between. In one embodiment, there may be a transparent outer lens, a backlit film image, and/or a transparent inner lens for each of the plurality of open frame sections.

In another embodiment, the at least one retainer cap may include an upper retainer cap and a lower retainer cap. Here, each of the upper and lower retainer caps may include a respective channel that includes a plurality of engagement projections therein. The projections may be configured for select engagement with a respective set of receptacles formed in the frame. In this respect, the upper and lower retainer caps may removably attach to the frame by snap-fit engagement. Alternatively, at least one of the upper or lower retainer caps may permanently attach to the frame or may be integrally formed with the frame.

The ornament of this embodiment may further include a set of lens tabs that inwardly project between adjoining open frame sections, a substantially rigid and upright internal frame having a smooth outer surface configured for flush engagement with a flat bottom surface of the at least one transparent inner lens, a plug insertable into the at least one retainer cap in non-rotatable compression-fit engagement therewith, and/or a light source positioned within the enclosure and associated with the plug. Here, the light source may also be fixed in non-rotatable relation relative to the plug.

In another embodiment, the ornament may include a substantially rigid and upright frame generally including a plurality of open frame sections each having a smooth inner surface and framing a respective viewing region. The frame itself may be formed into a prismatic shape by way of interconnecting the plurality of open frame sections. The ornament may further include a backlit film image having a flat top surface capable of being positioned flush against the smooth inner surface of one of the plurality of open frame sections. Additionally, a plug may be insertable into the cap in non-rotatable compression-fit engagement therewith.

A set of lens tabs may inwardly project between adjoining open frame sections and include at least one pinch point therein for positioning the backlit film image in a position viewable within the respective viewing region. The set of lens tabs may include at least two upper lens tabs and at least two lower lens tabs. Here, the ornament may also include a respective vertical lens tab positioned between a respective one of the at least two upper lens tabs and one of the at least two lower lens tabs. In one embodiment, the upper and lower lens tabs project inwardly a relatively greater distance than the vertical lens tabs. In another embodiment, each of the lens tabs forms an angle between 20 and 40 degrees relative to the respective open frame section.

The ornament may also include a cap configured for select engagement with at least a portion of the frame to define an enclosure with the backlit film image positioned therein. The ornament may include a pyramid-shaped reflector opposite the cap and extending inwardly into the frame. The reflector may have a baffle vent and an interior surface coated with a reflective material that reflects light from a light source onto the backlit film image. In an embodiment wherein the ornament includes two caps, at least one cap may include an upper cap and the other cap may include a lower cap. In this embodiment, each of the upper and lower caps includes a respective channel with a plurality of projections therein for engaging a reciprocal plurality of engagement receptacles in the frame.

Other feature of this embodiment may include at least one transparent outer lens having a smooth outer surface and a smooth inner surface. The smooth outer surface of the transparent outer lens may be positioned flush against the smooth inner surface of one of the open frame sections and the smooth inner surface may be positioned flush and co-planar with the flat top surface of the backlit film image. At least a portion of a vertical edge of the at least one transparent outer lens may engage within the at least one pinch point in compression-fit engagement therein. Alternatively or in addition to, at least a portion of a vertical edge of the backlit film image may reside in compression-fit engagement between one of the inwardly projecting lens tabs and the transparent outer lens. This embodiment may optionally include at least one transparent inner lens having a smooth outer surface configured for flush engagement with a flat bottom surface of the backlit film image and positioned within the pinch point to suspend the backlit film image therein in sandwiched relationship with the at least one transparent outer lens. Here, the backlit film image may include a shape different than the shape of the transparent outer lens or the transparent inner lens. Multiple of the transparent outer lenses may connect together to form an outer lens assembly. Similarly, multiple of the transparent inner lenses may connect together to form an inner lens assembly. The outer lens assembly may have a size and shape to encompass the inner lens assembly.

In another embodiment as disclosed herein, an ornament may include a substantially rigid and upright outer frame generally forming a plurality of outer open frame sections framing a respective viewing region, a plurality of interconnected outer lenses having a size and shape for select slide-in reception behind the outer frame and enclosing each of the open frame sections, a plurality of interconnected inner lenses having a size and shape for select slide-in reception behind the interconnected outer lenses, a substantially rigid and upright inner frame having a size and shape for select slide-in reception behind the interconnected inner lenses, a backlit film image sandwiched between at least one of the plurality of interconnected outer lenses and at least one of the plurality of interconnected inner lenses and suspended therein for viewing through at least one of the respective viewing regions, and an upper and lower cap each having respective upper and lower channels having a width sufficient for slide in reception and retention of at least the outer frame and the inner frame.

In another aspect of this embodiment, the outer lenses may sit flush against the outer frame sections and the inner frame sections may sit flush against the inner lenses. The outer frame and the inner frame may sandwich the outer lenses and the inner lenses therebetween, wherein the inner frame generally forms a plurality of inner open frame sections having a respective illumination region. Additionally, this embodiment may include a plug insertable into one of the upper or the lower caps in non-rotatable and compression-fit engagement therewith. The plug may facilitate drop in reception of a light source within the ornament. The ornament may also include a pyramid-shaped reflector coupled to the lower cap and positioned to reflect light from the light source onto the illumination regions. The backlit film image may be positioned to receive light from the light source through the illumination regions. Lastly, each of the upper and lower channels may include a plurality of detents configured for select snap-fit engagement with a respective plurality of receptacles formed from the outer frame.

In another aspect of the embodiments disclosed herein, the ornament may include a substantially rigid and upright frame generally forming a plurality of frame sections that frame a respective plurality of viewing regions. The frame may be a rectangular or a circular shape formed by interconnection of the plurality of frame sections. At least one transparent lens may be positioned to enclose at least one of the plurality of frame sections, wherein at least one backlit film image may be aligned for viewing through the at least one transparent lens within the viewing region of the frame section enclosed by the at least one transparent lens. The frame may include a set of vertical lens tabs that inwardly project between adjoining frame sections. In one embodiment, the set of vertical lens tabs may extend from the upper portion of the frame to the lower portion of the frame, such as at an angle between 35 and 55 degrees relative to the adjoining frame sections. In another embodiment, the set of vertical lens tabs may include a set of T-shaped lens tabs. Each T-shaped lens tab may include a channel extension that is positioned approximately perpendicular to a vertical connector and inwardly extends therefrom to form a reception channel therebetween with at least one channel retainer generally perpendicularly extending from the channel extension. The reception channel is of a size and shape for select slide-in reception and/or removal of at least one of the transparent lenses (including an arced transparent lens) for upright support thereof.

In another embodiment, the at least one transparent lens may include a plurality of transparent outer lenses and a plurality of transparent inner lenses. Here, the plurality of transparent outer lenses may be positioned relative to the plurality of transparent inner lenses to encapsulate the at least one backlit film image in between. In another aspect of such an embodiment, the at least one transparent lens may include three arced transparent lenses each having a smooth outer surface selectively positionable flush against a commensurate arced smooth inner surface of the frame. The three arced transparent lenses may enclose three of the plurality of viewing regions to further insulate the interior of the enclosure. Another feature of this embodiment might include wherein each of the three arced transparent outer lenses include a smooth inner surface selectively positionable flush against a commensurate smooth outer surface of a respective arced transparent inner lens to encapsulate the backlit film in between. Here, the arc of the inner surface of the transparent outer lenses would be approximately the same as the arc of the outer surface of the transparent inner lenses.

The ornament as disclosed in this embodiment may further include an upper retainer cap configured to selectively receive and retain an upper portion of the frame. Additionally, the ornament may include a lower base having a channel configured to selectively receive and retain a lower portion of the frame generally opposite the upper retainer cap. The channel may be positioned adjacent an upwardly projecting and interiorly positioned base lens tab. The channel and the base lens tab cooperate to simultaneously support an interior side and an exterior side of the lower portion of the frame when engaged with the base. The upper retainer cap, the lower base, and the frame with the at least one transparent lens may then define an enclosure. In an alternative aspect of this embodiment, the lower base may include a downwardly extending skirt generally positioning the enclosure above a support surface. Here, the height of the downwardly extending skirt may be relatively larger than a depth of the channel to facilitate formation of the channel therein.

In other features, the ornament may include a domed reflector coupled to the upper retainer cap opposite the lower base and positioned to reflect light from a light source onto the backlit film image. A plurality of feet may couple to the lower base and be positioned proximate the downwardly extending skirt. Here, the feet may extend the lower base off the support surface. To this end, a base vent may be formed in the lower base and a cap vent may be formed in the upper retainer cap. The base vent and the cap vent help facilitate flow-through air convection cooling within the enclosure by providing vented coupling to the ambient air temperatures. This may be particularly useful to help cool the enclosure when a light source is positioned within the enclosure and provides illumination for the backlit films. In one embodiment, the light source may be associated with the lower base in non-rotatable relation therewith. In another aspect of this embodiment, the light source may include a battery powered light coupled to an energy source positioned within the lower base.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
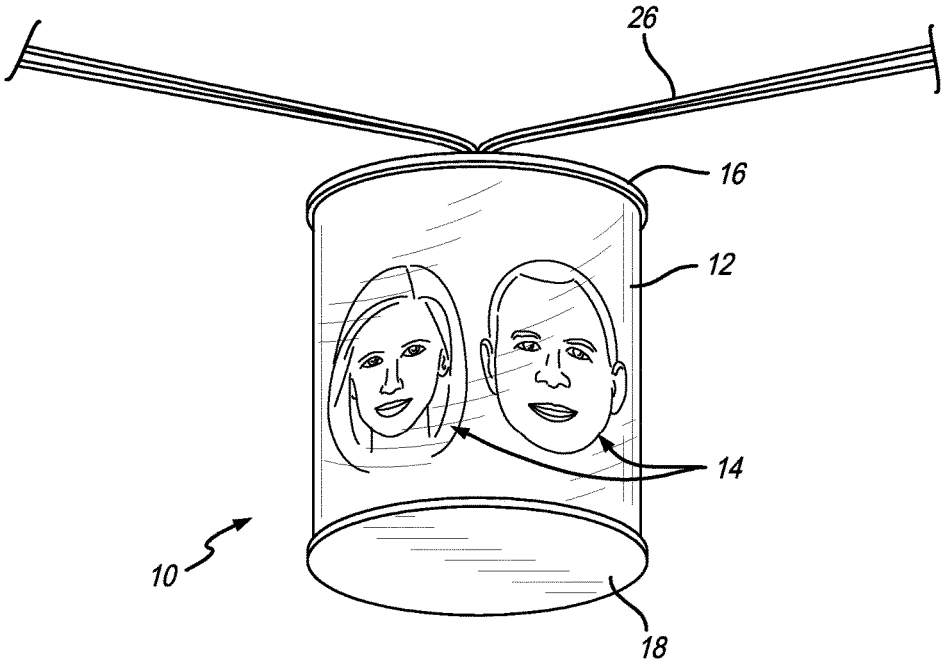
FIG. 1 is a fragmented perspective view of a backlit ornament constructed in accordance with the present disclosure.

The present invention relates to an ornament referred to generally in FIG. 1 by the reference numeral 10. The ornament comprises a sheet of backlit film 12 bearing a custom-printed image 14 and rolled into a generally cylindrical shape retained by a pair of generally circular upper and lower retainer caps 16 and 18. At least the upper retainer cap 16 has an opening 20 (FIG. 2) formed therein for slide-fit reception of and engagement with the base 22 or the like of a light source 24 (FIG. 3), such as a small light mounted along the length of an elongated strand 26 of conductors carrying multiple light sources of a type used in a conventional strand of decorative Christmas or holiday lights or the like.

The sheet of backlit film 12 comprises a sheet of known backlit film material such as that commercially available in rolls of different sheet lengths suitable for use with wide format inkjet media from Eastman Kodak Company, Rochester, N.Y., under the brand name Kodak Premium Backlit Film, or from Hewlett-Packard Development Company of Houston, Tex., under the brand name HP Premium Vivid Color Backlit Film. Such backlit film is quickly and easily used to apply by printing the custom image 14 thereto, such as a photograph or portion thereof displaying the image of friends or family members, as shown in the illustrative drawings. Persons skilled in the art will recognize and appreciate, however, that alternative backlit film sheets in planar form, such as in 8.5×11 inch sheets, can be used in a standard home inkjet printer or the like.

Backlit film is particularly preferred as it produces a different visual effect when compared to transparent film. More specifically, transparent film permits viewing through the film in areas where a color or visual image is not present, and may even permit viewing through the film in areas where a lighter color or image is present. This occurs because there is no background. As a result, the transparent film permits viewing into the body of the ornament, such as the light source disclosed in the Simpson reference described above. This is not the case with opaque backlit film. Rather, backlit film is akin to printing an image to white paper, which was only recently made possible, in part, through advancements in digital printing and media technologies. In one embodiment, the backlit film may be made from a matte on the printing side and a gloss on the other side. In general, the backlit film is typically from 40% to 90% opaque, although, preferably, the backlit film is 77% opaque. Higher opacity tends to hold vivid photographic colors better in reflective light. Transparent film, as mentioned above, does not. Accordingly, the opacity of the backlit film enhances maximum color transmittal, even without light. Transparent film, on the other hand, requires illumination, otherwise the color scheme looks dark and muted because there is no background to fall back on. Transparent film may work well for overhead projectors where the image is viewed on a screen as opposed to viewed directly, whereas backlit film is best viewed directly because of its opacity.

After printing of the custom image 14 onto the backlit film sheet 12, the backlit film sheet 12 is cut into a desired length and width for subsequent rolling into a generally hollow cylindrical shape. In this regard, in accordance with one preferred form of the invention, the backlit film sheet 12 is trimmed to include the custom image 14, with an exemplary sheet length of at least about 5.5 inches and a selected height on the order of about 2-3 inches (as viewed in FIG. 2). When this trimmed backlit sheet 12 bearing the custom image 14 is rolled into a hollow cylindrical shape having a diametric size of about 1.75 inches, there is a slight overlap of the opposed ends of the sheet 12. A thin layer of a selected adhesive 28 (FIG. 2) can be applied to one of these overlapping ends for securing the backlit film sheet 12 in the cylindrical shape of the desired size. Persons skilled in the art will recognize, however, that alternative means may be used for securing the opposite ends of the backlit film sheet 12, and/or that the film sheet 12 can be rolled into a different cylindrical size. Persons skilled in the art will also recognize that the entire backlit film sheet 12 may be coated on the reverse or rear side with a suitable pressure sensitive adhesive, in lieu of the selected adhesive 28.

The cylindrical backlit film sheet 12, bearing the custom image 14, is then assembled quickly and easily with the pair of upper and lower retainer caps 16 and 18, respectively. The upper and lower retainer caps 16, 18 are preferably lightweight, thin (e.g., 0.045 mm), flexible and made from a thermoplastic material. As shown best in FIG. 2, both of these retainers caps 16, 18 include an annular rim 30 against which the associated upper or lower end of the cylindrical film sheet 12 fits snugly, in combination with an outwardly radiating upper or lower flange 32 that projects a short distance beyond the film sheet 12 assembled against the rim 30. Both caps 16, 18 are desirably constructed from a lightweight and economical plastic material. If desired, a small adhesive bead (not shown) can be applied to the rims 30, or alternately to the reverse side of the film sheet 12 along the top and bottom edges, for more permanently securing the film sheet 12 to the cap rims 30. As a further alternative, persons skilled in the art will appreciate that a shallow groove (not shown) may be included at the juncture of the rim 30 and flange 32 for assisting in support and retention of the backlit film sheet 12.

Figure 2:
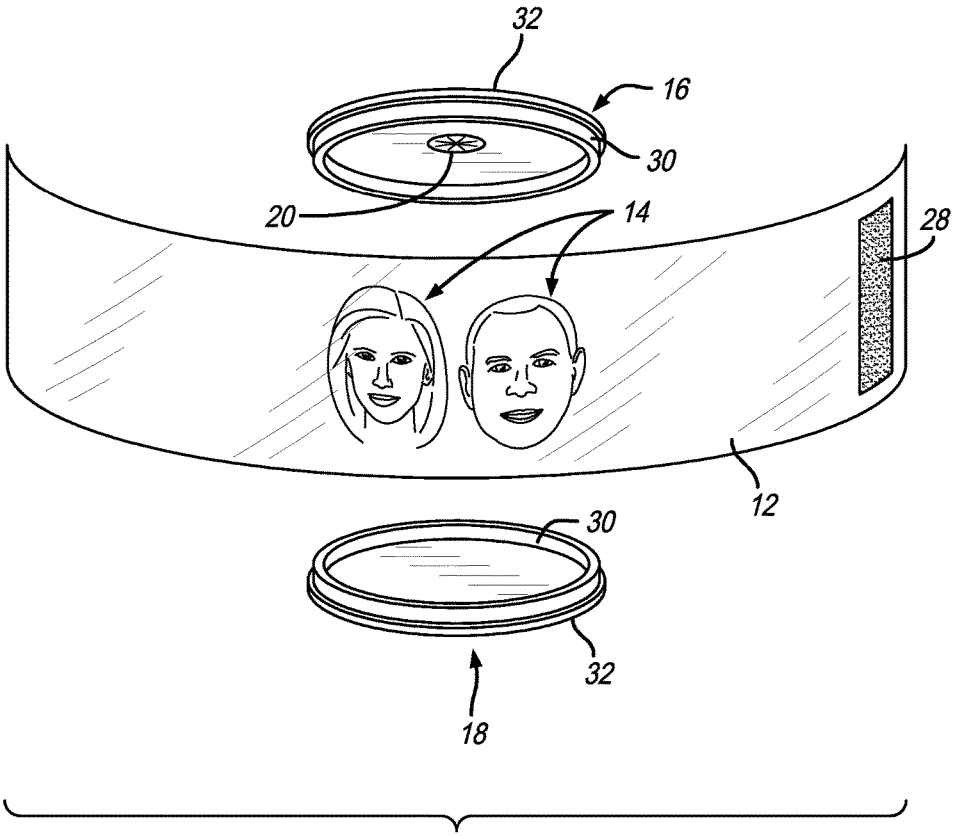
FIG. 2 is a perspective view showing a backlit film sheet bearing an image in exploded relation with upper and lower caps.
Figure 3:
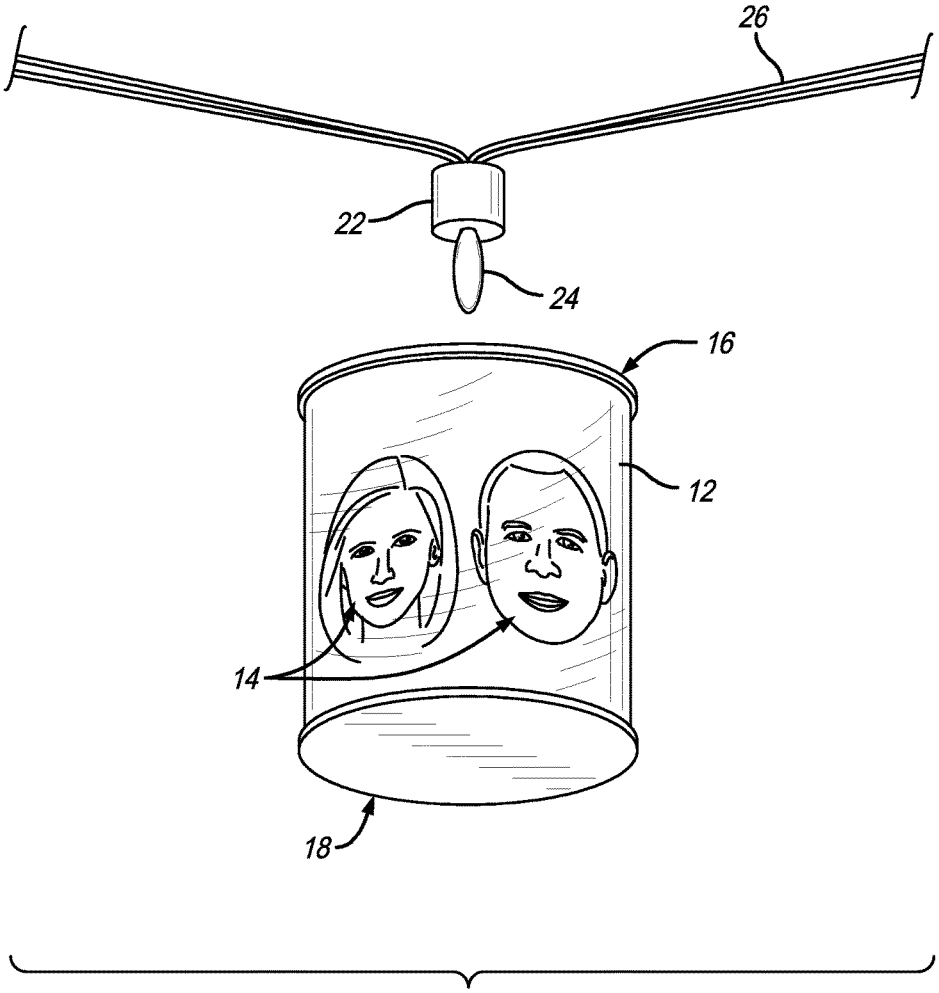
FIG. 3 is a perspective view showing the assembled ornament in exploded relation with an illuminating light source, such as a Christmas tree light strand.

At least one of the upper and lower retainer caps 16, 18, and preferably the upper cap 16, includes the small opening 20 for receiving and supporting the base 22 of one of light source 24. FIG. 2 shows the upper cap 16 having an X-slit formed centrally therein as the opening 20. Prior to receiving the light source 24, the X-slit 20 is substantially closed to prevent light leakage from the hollow ornament interior. But the X-slit 20 accommodates quick and easy press-fit reception of the light source 24 for friction-fit engagement of the light base 22 in a manner which securely supports and positions the associated light source 24 within the hollow ornament interior (FIGS. 1-3).

The light source 24 thus back-illuminates the custom image 14 on the now-cylindrical back-lit film sheet 12, resulting in a highly pleasing and different type of ornament visually displaying the custom image 14, such as the exemplary photograph of friends and/or family members, or other selected customized artwork. This ornament 10 can be used alone, preferably mounted at a selected location along a strand 26 of lights 24 in association with one of the lights 24 (FIGS. 1-3), or alternately, multiple ornaments 10 each having the same or a different custom image 14 printed thereon can be mounted along the strand 26 (FIG. 4) each in association with a respective one of the lights 24. In either case, the resultant ornament or ornaments 10 provide a unique and pleasing custom decorative effect that is especially suited for use as a holiday decoration such as Christmas and the like.

Figure 5:
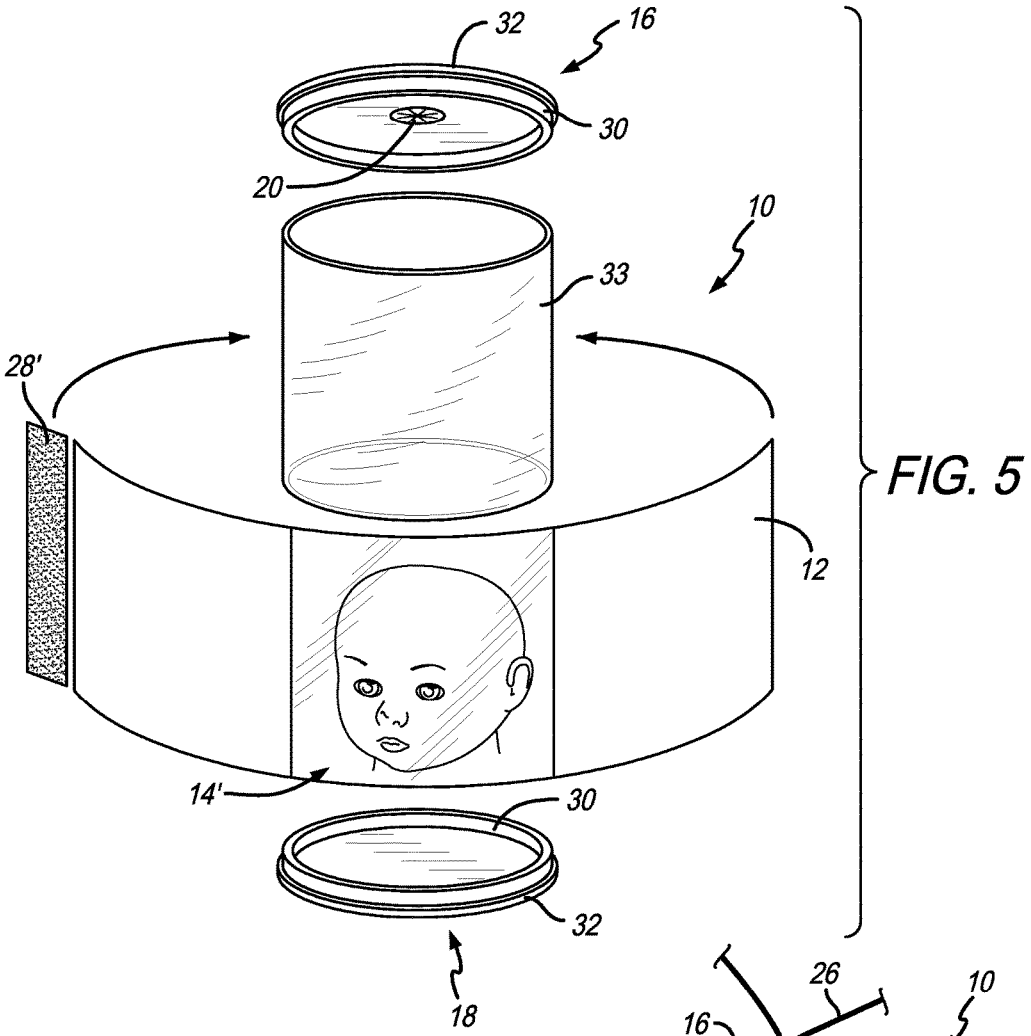
FIG. 5 is an exploded perspective view of an alternative ornament, including a transparent sleeve for supporting the backlit film.
Figure 6:
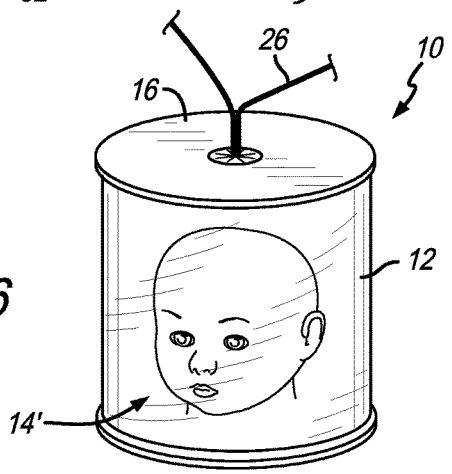
FIG. 6 is an assembled perspective view of the ornament of FIG. 5.

Additionally, FIGS. 5-6 illustrate another embodiment of the ornament 10, including a transparent sleeve 33 for use in supporting the backlit film 12 when connected to the upper retainer cap 16 and the lower retainer cap 18. The transparent sleeve 33 is generally formed from a somewhat rigid or hard plastic support layer configured to receive the backlit film 12 in a supportive upright position. As shown best in FIGS. 5, 8 and 9-12, the transparent sleeve 33 (and the sleeve 33', as described below) includes a smooth inner cylindrical surface and a smooth outer cylindrical surface. As described above, the backlit film 12, such as the one shown in FIG. 5, is preferably cut to a height that is approximately the same height as the transparent sleeve 33. Furthermore, the backlit film 12 is preferably cut to a length that allows the film 12 to easily encompass the outer diameter of the transparent sleeve 33 in a manner that allows partial overlap so that the adhesive 28', such as clear plastic tape, a gel-like adhesive, or the like, can adhere adjoining sections of the backlit film 12 generally circumferentially around the exterior of the transparent sleeve 33. As such, the backlit film 12 containing an alternative image 14' easily wraps around and attaches to the outside of the transparent sleeve 33 such that substantially the entire area of its flat bottom surface is positioned flush against the smooth outer cylindrical surface of the transparent sleeve 33. The backlit image 12 may also be cut somewhat short such that portions of the film 12 do not overlap when placed around the exterior of the transparent sleeve 33. Here, it may be necessary to apply two strips of the adhesive 28' to hold each end of the backlit film 12 around the exterior of the transparent sleeve 33. In this embodiment, the backlit film 12 may be adhered to a portion of the transparent sleeve 33 instead of to itself. The backlit film 12 with the accompany image 14' may be attached to the transparent sleeve 33 before or after connection to the upper and lower end caps 16, 18, as described below.

The transparent sleeve 33 is connected to the upper and lower end caps 16, 18 in accordance with the embodiments disclosed herein. For example, with respect to FIGS. 5 and 6, the upper and lower retainer caps 16, 18 may attach by slide-fit or snap-fit engagement of the respective annular rims 30 within the interior of the transparent sleeve 33. In this embodiment, the annular rims 30 are retained within the interior of the transparent sleeve 33 by friction fit. As such, the retainer caps 16, 18 are selectively removable from the transparent sleeve 33 by unfitting or unsnapping the annular rims 30 out from within the transparent sleeve 33. Alternative embodiments may include other means for mechanically or adhesively attaching (permanently or temporarily) the retainer caps 16, 18 to the transparent sleeve 33. Once fully assembled as shown in FIG. 6, the aforementioned light source connected to the elongated strand 26 may be disposed within the interior of the transparent sleeve 33 to illuminate the image 14' on the backlit film 12.

Figure 7:
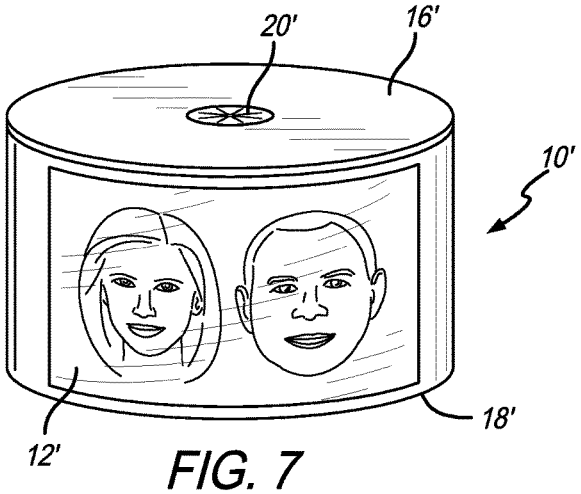
FIG. 7 is a perspective view showing one alternative preferred form of the ornament disclosed herein.
Figure 8:
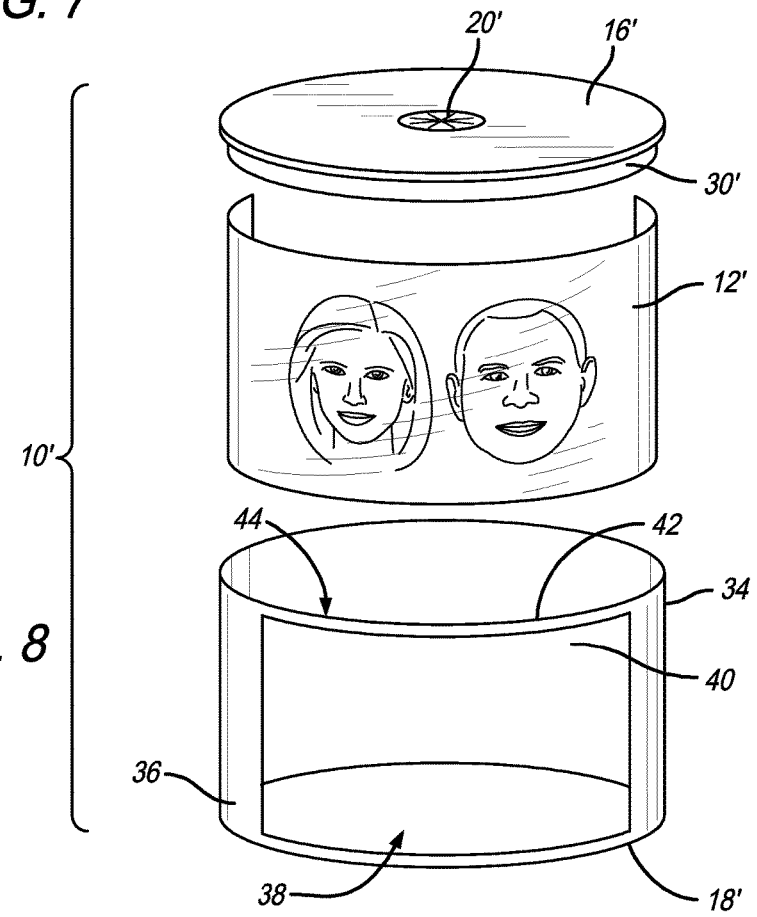
FIG. 8 is an exploded perspective view showing the alternative embodiment of FIG. 7.

An alternative preferred embodiment of the invention is shown in FIGS. 7-8. As shown, a modified ornament 10' is provided in a generally non-cylindrical shape such as the illustrative oval or elliptical configuration, with an upstanding closed loop wall segment 34 having a opaque or translucent region 36 lining a frontal portion or segment 38 defined by a pair of generally transparent overlying films 40, 42 forming an upwardly open pocket 44 for slidably receiving and supporting a piece of backlit film 12' having a selected image printed thereon. The surfaces forming the pocket 44 are generally smooth to mitigate refraction of light therein. After printing the selected image, the backlit film 12' is trimmed to size as needed, and then slidably fitted into the upwardly open pocket 44 between the transparent films 40, 42, and an upper lid or cap 16' is fitted onto the underlying closed loop wall segment 12' as by slidably fitting an annular rim 30' into said wall segment 12'. If desired, an adhesive bead (not shown) can be used to essentially permanently secure these components together. A lower lid or cap 18' may also be fitted onto the lower end of the closed loop wall segment 12', as needed or desired.

Figure 4:
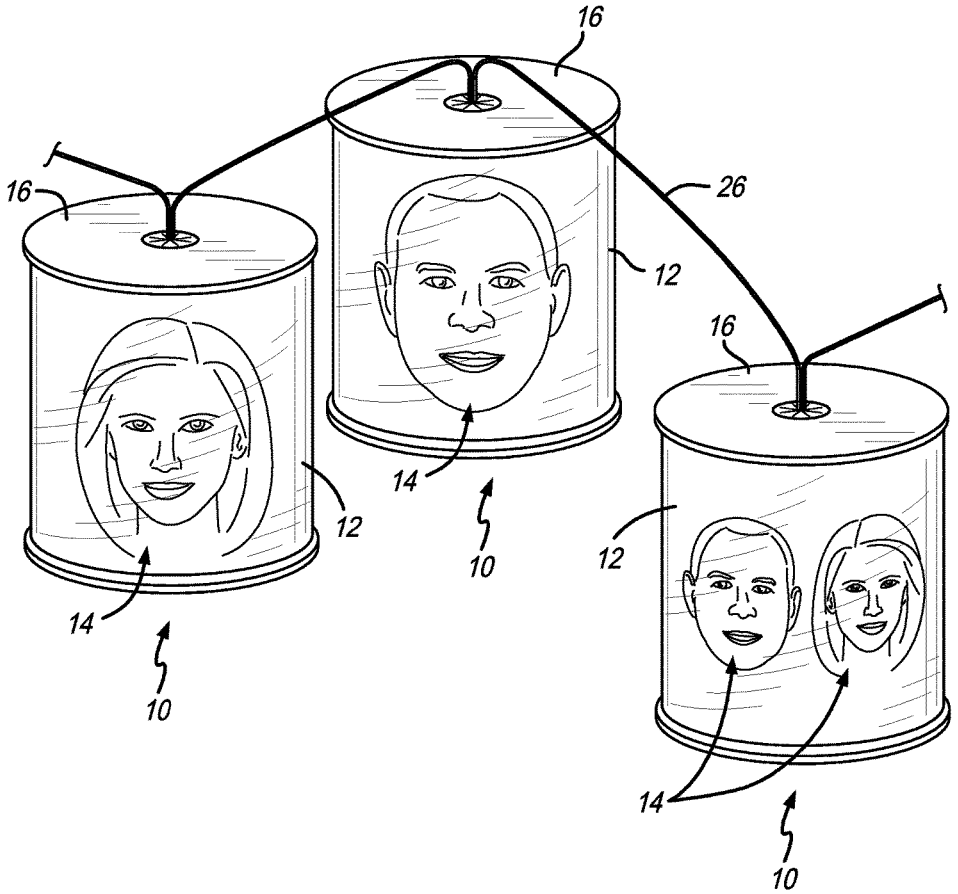
FIG. 4 is a perspective view showing multiple ornaments, each coupled to a light source on an elongated strand.

The upper lid or cap 16' includes a central opening 20', such as an X-slit as previously shown and described with respect to FIGS. 1-4, for receiving and retaining the light 24 (not shown in FIGS. 7-8) such as one of multiple holiday lights 24 on the strand 26 as viewed in FIG. 4. In use, the resultant ornament 10' receives and supports the backlit film 12' with the selected image thereon for suitable backlighting by means of the light 24, with the balance of the ornament 10' being constructed to be substantially opaque or translucent to provide a pleasing lighted ornament.

Figure 9:
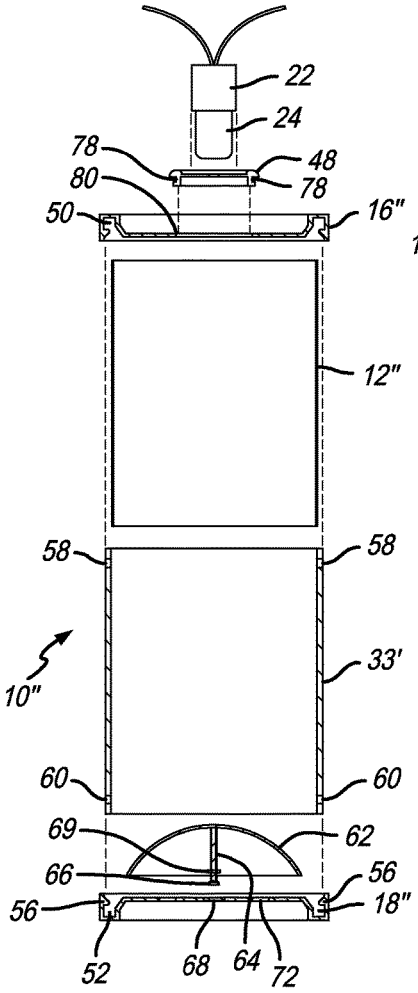
FIG. 9 is an exploded cross-sectional view of an alternative ornament with a backlit image, including a substantially rigid transparent sleeve that snaps into a pair of end caps.

Furthermore, FIGS. 9-13 illustrate an alternative embodiment of the ornament with a backlit film image as disclosed herein. More specifically, FIG. 9 illustrates an exploded cross-sectional view of an alternative ornament 10" including a modified upper retainer cap 16", a modified lower retainer cap 18", a modified transparent sleeve 33', a backlit film 12" and a plug 48 that slidably engages the upper retainer cap 16". In this embodiment, each of the upper and lower retainer caps 16", 18" include an upper and lower channel 50, 52, respectively configured for slide-fit reception of the transparent sleeve 33'. Additionally, the upper and lower retainer caps 16", 18" both include a series of upper and lower engagement projections 54, 56 configured to slidably engage one of a plurality of the upper or lower apertures 58, 60 formed out of the transparent sleeve 33'. Engagement of the upper and lower apertures 58, 60 with the upper and lower engagement projections 54, 56 is described in more detail below with respect to FIG. 11.

Figure 10:
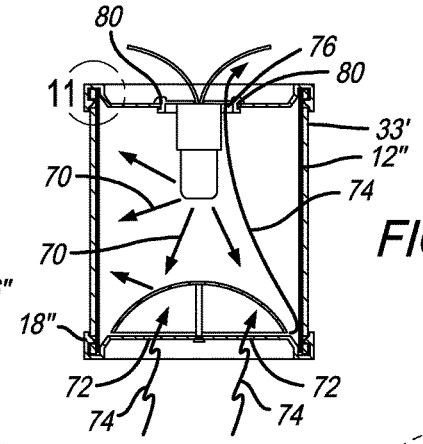
FIG. 10 is an assembled cross-sectional view of the alternative ornament of FIG. 9.

Furthermore, the ornament 10" shown in FIG. 9 includes a domed reflector 62 having an extension 64 with a flared end 66 configured to snap-fit or press-fit engage a retaining aperture 68 in the lower retainer cap 18". The diameter of the retaining aperture 68 is preferably approximately the same diameter as the outer diameter of the extension 64. In this respect, it may be preferable that the diameter of the retaining aperture 68 be somewhat slightly larger than the outer diameter of the extension 64 to facilitate slide-fit reception thereof. The flared end 66 is also preferably sized to slidably extend through the retaining aperture 68 yet wide enough to retain the domed reflector 62, as generally shown in FIG. 10, to the lower retainer cap 18". Once inserted, the domed reflector 62 remains affixed as the flared end 66 and a stop collar 69 sandwiches a portion of the lower retainer cap 18" therebetween. Here, the domed reflector 62 is removably affixed to the lower retainer cap 18". Removal simply requires pulling the extension 64 and the flared end 66 back through the retaining aperture 68. Alternatively, the domed reflector 62 may be temporarily or permanently adhesively or mechanically attached (e.g., screwed or nailed) to the lower retainer cap 18".

Use of the domed reflector 62 reduces light fall-off through the bottom of the ornament 10" and serves as a baffle for ventilation holes. Additionally, it may also be desirable to couple a domed reflector to the upper retainer cap 18" (not shown). Of course, such an upper domed reflector would need to facilitate extension of the light source 24 therethrough. FIG. 10 more specifically illustrates a series of light waves 70 reflecting off the domed reflector 62 for redirection into the transparent sleeve 33' and the backlit film 12". Preferably, the interior surface of the domed reflector 62 is made from or coated with a reflective material. Additionally, FIG. 10 further illustrates a plurality of ventilation apertures 72 in the lower retainer cap 18" allowing a series of coolant waves 74 to enter into the enclosure of the ornament 10", proceed around the domed reflector 62, and exit out through a set of plug or upper retainer cap ventilation apertures 76. The ventilation apertures 72, 76 facilitate airflow through the interior of the ornament 10" so that the ornament 10" is capable of convective cooling throughout the interior enclosure.

Figure 11:
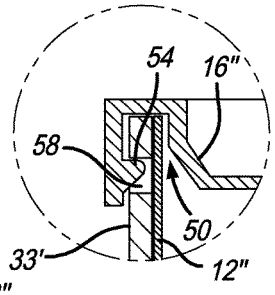
FIG. 11 is an enlarged cross-sectional view taken about the circle 11 in FIG. 10, further illustrating snap-fit reception of the end cap into the transparent sleeve.
Figure 12:
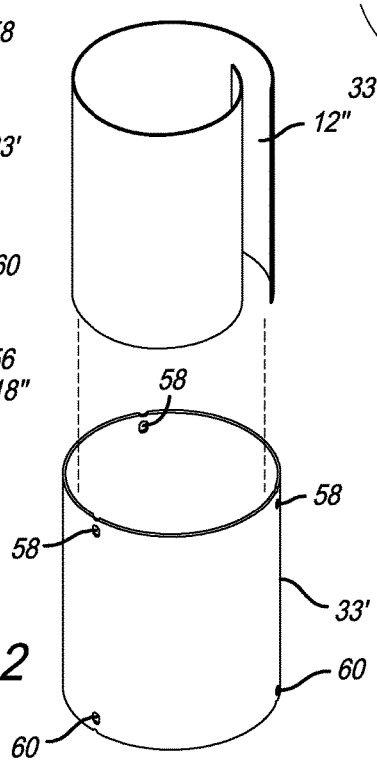
FIG. 12 is an partial exploded perspective view illustrating slide fit reception of the backlit film within the transparent sleeve.

FIG. 11 is an enlarged cross-sectional view illustrating engagement of the upper retainer cap 16" with the transparent sleeve 33'. More specifically, FIG. 11 illustrates engagement of the upper engagement projection 54 with the upper aperture 58 such that the upper retainer cap 16" removably engages the transparent sleeve 33'. The upper channel 50 may flex outwardly to accommodate insertion of the transparent sleeve 33' around the upper engagement projection 54. For example, the upper retainer cap 16" may be made from a substantially resilient and lightweight plastic material that permits slight outward flexing about the upper channel 50. This allows for enlargement of the upper channel 50 to facilitate insertion of the transparent sleeve 33' therein, such that the upper engagement projection 54 may slidably insert into and engage the upper aperture 58. Once engaged, the resilient plastic material comprising the upper retainer cap 16" retains its shape substantially as shown in FIG. 11. FIG. 11 further illustrates the flat bottom surface of the backlit film 12" positioned flush against the smooth outer surface of the transparent sleeve 33'. As shown in FIG. 12, the transparent sleeve 33' includes a plurality of upper apertures 58 circumferentially disposed about an upper portion thereof and configured for slide-fit or snap-fit engagement with a plurality of the upper engagement projections 54 disposed circumferentially around the interior of the upper channel 50 of the upper retainer cap 16". Accordingly, each upper engagement projection 54 engages a respective upper aperture 58 to ensure the upper retainer cap 16" remains substantially affixed to the transparent sleeve 33'. Further to FIG. 12, the backlit image 12" may be flexible such that it can be manipulated into the curved configuration as shown, wherein substantially the entire area of the flat top surface of the backlit film 12" can be positioned flush against the smooth inner surface of the transparent sleeve 33' at least in part because the transparent sleeve 33' does not include any corrugations. This enhances visibility of the image 14 on the backlit film 12" when the light source 24 is illuminated.

Likewise, the transparent sleeve 33' includes the plurality of lower apertures 60 (FIG. 12) configured for slide-fit engagement with the plurality of corresponding lower engagement projections 56 in the lower retainer cap 18". The lower retainer cap 18" is also preferably manufactured from a substantially resilient yet flexible plastic material that allows for enlargement of the lower channel 52 upon desired insertion of the transparent sleeve 33' therein. In this respect, the lower channel 52 may flex outwardly to accommodate insertion of the transparent sleeve 33' beyond the lower engagement projections 56 for slide-fit or press-fit engagement with the corresponding lower apertures 60. Once engaged, the substantially resilient plastic material recovers back to its preferred shape as shown in FIGS. 9-10. Removal of either of the upper or lower engagement projections 54, 56 from the respective upper or lower apertures 58, 60 requires flexing the upper or lower retainer cap 16", 18" outwardly, thereby expanding the respective upper and/or lower channels 50, 52, to facilitate disengagement the projections 54, 56 from the apertures 58, 60.

In an alternative embodiment, the transparent sleeve 33' and/or the backlit film 12" may be permanently affixed to each of the upper retainer cap 16" and/or the lower retainer cap 18" by disposing an adhesive (not shown) in each of the respective upper and/or lower channels 50, 52. The adhesive bonds respective portions of the transparent sleeve 33' to the upper and lower retainer caps 16", 18". This embodiment may be more robust than other embodiments disclosed herein as it is not meant to be disassembled. Additionally, in another alternative embodiment, one or both of the retainer caps 16, 18 may screw into and out from a portion of the transparent sleeve 33' to be secured thereto or removed therefrom.

FIG. 12 is a partial exploded perspective view illustrating that the backlit film 12" slidably resides within the interior of the transparent out sleeve 33'. The backlit film 12", when assembled, is located to the interior of the transparent sleeve 33' in a manner best shown in FIG. 11. The backlit film 12" is configured to outwardly expand flush against the interior surface of the transparent sleeve 33', as described above. In this respect, the transparent sleeve 33' acts as a support that positions or carries the backlit film 12". The engagement projections 54, 56 are configured to wholly or partially extend into the apertures 58, 60 in the transparent sleeve 33', as best shown in FIG. 11, only so much as to allow for flush mounting of the backlit film 12" against the interior of the transparent sleeve 33'. Like the transparent sleeve 33', portions of the backlit film 12" may reside within respective upper and lower channels 50, 52 in the upper and lower retainer caps 16", 18". In a particularly preferred embodiment, the backlit film 12" may be sandwiched between a portion of the channel 50 and/or 52 and the interior of the transparent sleeve 33' upon press-fit engagement of the upper and lower engagement projections 54, 56 with the upper and lower apertures 58, 60 to prevent future movement of the backlit film 12" should the ornament 10" move after assembly. Of course, as described above, each of the upper and lower channels 50, 52 may include or be configured to receive an adhesive that glues the backlit film 12" and/or the transparent sleeve 33' to the upper and/or lower retainer caps 16", 18".

Figure 13:
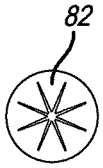
FIG. 13 is a top view of a plug selectively insertable into the top end cap.

Another feature of the ornament 10" shown with respect to FIGS. 9-10 and 11 is the plug 48, which is preferably made from a rubber material. The plug 48 preferably inserts into the upper retainer cap 16" for compression and/or press-fit engagement therewith. In a similar manner, the plug 48 may selectively receive the light source 24 and/or the base 22 for similar compression and/or press-fit engagement therewith to affix the light source 24 in place. In this respect, the plug 48 may further include an engagement channel 78 that selectively engages a flange 80 formed from a portion of the upper retainer cap 16". The plug 48 may selectively snap into or be removed from the upper retainer cap 16", as needed. In one embodiment, the plug 48 disclosed herein includes a plurality of flexible insertion flaps 82, as shown in FIG. 13, capable of flexing to receive the aforementioned base 22 and the light source 24 by friction-fit reception. The insertion flaps 82 may operate in a manner similar to the aforementioned small opening/X-slit 20 described with respect to the embodiments above. Of course, a person of ordinary skill in the art will readily recognize that there may be many different ways of facilitating insertion, retention and/or connection of the light source 24 (and possible the corresponding base 22) into the interior of the transparent sleeve 33' to accomplish backlit lighting of the film 12". The removable aspect of the plug 48 allows the ornament 10" to be used with different lighting fixtures. For example, instead of slide-fit reception of the base 22 and the light source 24, the plug 48 may be made as part of a pre-formed combination light source and plug. Here, the plug/light source simply attach to the ornament 10" through snap-fit or press-fit engagement of the engagement channel 78 with the flange 80. This embodiment may be particularly preferred for use with the aforementioned elongated strand 26, such as for use in stringing multiple ornaments 10, 10', 10" in association with the Christmas tree strand as shown in FIG. 4.

In an alternative embodiment, the plug 48 may insert into the upper retainer cap 16" for non-rotatable compression and/or press-fit engagement therewith. In a similar manner, the plug 48 may selectively receive the light source 24 and/or the base 22 for similar non-rotatable compression and/or press-fit engagement therewith to secure the light source 24 in place. In this respect, upon insertion, retention, and/or connection of the light source 24 (and possibly the corresponding base 22) with the interior of the transparent sleeve 33', the light source 24 is thereafter fixed within the interior of the transparent sleeve 33' and not permitted to rotate relative to the plug 48, the upper retainer cap 16", or the transparent sleeve 33'. Non-rotatably engaging the light source 24 and/or the base 22 within the ornament 10" may allow the light source 24 and/or the base 22 to be more snugly and securely retained within the ornament 10", thereby reducing the likelihood the light source 24 unintentionally becomes loose or separates after assembly.

Persons skilled in the art will recognize and appreciate that the closed loop shape of the ornament 10, 10', 10" can be provided in virtually any desired closed loop configuration, such as circular (FIGS. 1-6 and 9-13) or oval (FIGS. 7-8) as shown, or alternative closed loop shapes including but not limited to triangles, rectangles and other polygons, truncated cones, and the like. Additionally, the backlit film 12, 12', 12" is preferably flexible and at least substantially smooth on each side such that the backlit film 12, 12', 12" sits flush with the surface area of the transparent sleeve 33 substantially along its entire surface area. In this respect, the backlit film 12, 12', 12" may have a consistent thickness throughout its entire surface area, which means the backlit film 12, 12', 12" is free of projections, lumps, indentations, etc.

Figure 14:
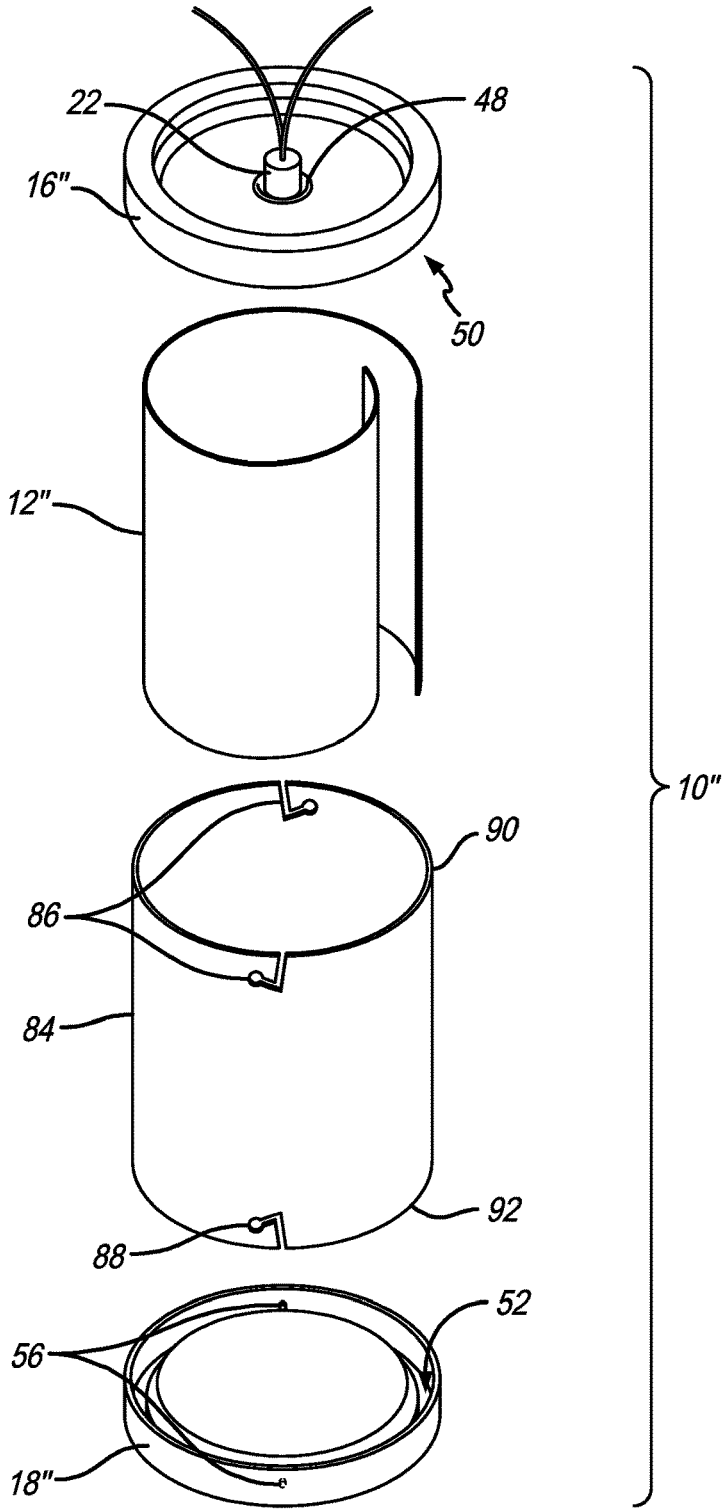
FIG. 14 is an exploded perspective view of an alternative embodiment of a backlit ornament, illustrating the transparent sleeve having an L-shaped slot for select slide-in reception of the end cap.
Figure 15:
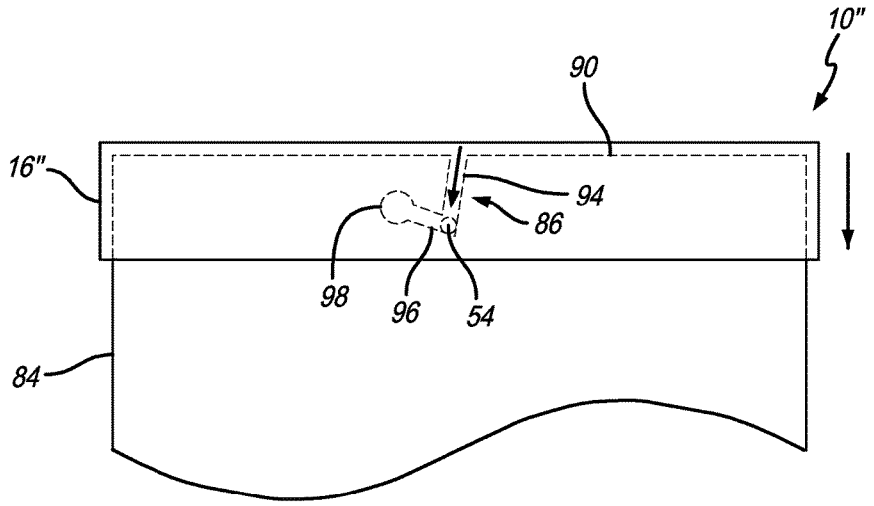
FIG. 15 is a side view of the alternative backlit ornament of FIG. 14, further illustrating initial depression of the end cap into the L-shaped slot of the transparent sleeve.
Figure 16:
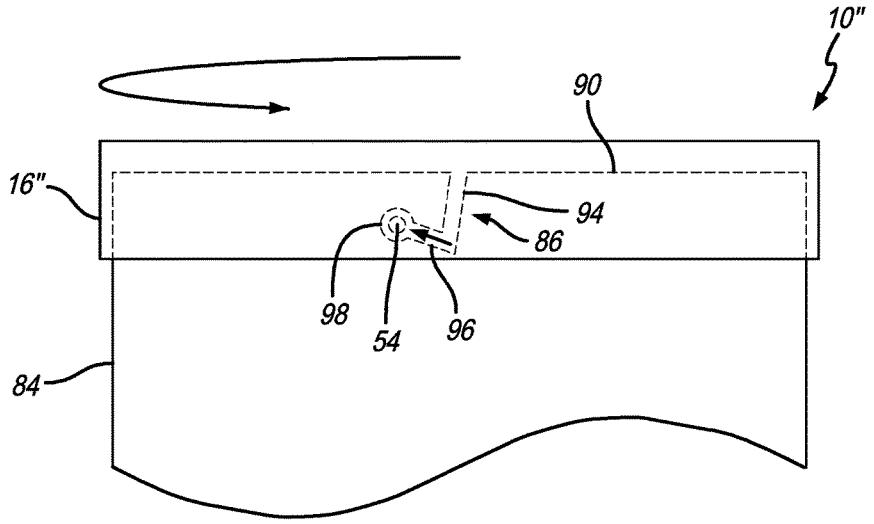
FIG. 16 is a side view similar to FIG. 15, further illustrating subsequent rotation of the end cap within the L-shaped slot of the transparent sleeve.

Additionally, FIGS. 14-16 illustrate an alternative embodiment of the backlit ornament 10" including a slotted transparent sleeve 84 with at least a pair of upper L-shaped slots 86 for select engagement and retention of the upper engagement projections 54 (FIGS. 15-16) in the upper retainer cap 16" and at least a pair of lower L-shaped slots 88 (one shown in FIG. 14) for selective engagement and retention of the lower engagement projections 56 in the lower retainer cap 18". Additionally, the upper channel 50 of the upper retainer cap 16" is configured for slide-fit reception of an upper edge 90 of the slotted transparent sleeve 84 and the lower channel 52 of the lower retainer cap 18" is configured for slide-fit reception of a lower edge 92 of the transparent sleeve 84. In this respect, the upper retainer cap 16" and the lower retainer cap 18" help retain the backlit film 12" flush against the smooth inner surface of the slotted transparent sleeve 84 in the manner described herein. More specifically in this respect, the upper engagement projections 54 and the lower engagement projections 56 project inwardly within the respective upper and lower channels 50, 52 and are of a size and shape for select slide-in engagement with the respective upper and lower L-shaped slots 86, 88 in the slotted transparent sleeve 84. In some embodiments, the upper engagement projections 54 and/or the lower engagement projections 56 may be positioned approximately half way down within the respective upper and lower channels 50, 52 to facilitate engagement with the upper and lower L-shaped slots 86, 88. Alternatively, the upper engagement projections 54 and/or the lower engagement projections 56 may be positioned at or near the top of the respective upper and/or lower engagement channels 50, 52 and/or at or near the bottom of the respective upper and/or lower engagement channels 50, 52, depending on the depth of the L-shaped engagement slots 86, 88. Additionally, the upper and/or lower engagement projections 54, 56 may span the width of the respective upper and/or lower engagement channels 50, 52.

More specifically, each of the upper and lower L-shaped slots 86, 88 may include a longitudinal cutout 94, a lateral offset cutout 96, and a seating cutout 98 formed at a distal end of the lateral offset cutout 96, as best shown in FIGS. 15 and 16. In some embodiments, the longitudinal cutouts 94 may extend in and away from the respective edges 90, 92 and substantially parallel to a longitudinal axis of the slotted transparent sleeve 84. Here, the longitudinal cutouts 94 are edge accessible from the respective upper and/or lower edges 90, 92. In the same or other embodiments, the lateral offset cutouts 96 may be substantially orthogonal to the longitudinal cutouts 88, may be substantially parallel to the edges 90, 92, and/or may be angled. For example, the embodiments disclosed with respect to FIGS. 15 and 16 show that the lateral offset cutouts 96 angle upwardly toward the upper edge 90 and away from the bottom of the longitudinal cutout 94.

FIGS. 15 and 16 also more specifically illustrate operational engagement of one of the upper projections 54 with one of the upper L-shaped slots 86. For example, FIG. 15 is an enlarged side view of the backlit ornament 10" of FIG. 14, illustrating initial engagement of the upper engagement projection 54 with the upper L-shaped slot 86. The upper retainer cap 16" and the slotted transparent sleeve 84 are first pressed axially together relative to one another to slidably insert the upper edge 90 into the upper channel 50. With proper alignment, the upper engagement projection 54 slidably extends into the longitudinal cutout 94 of the upper L-shaped slot 86 until the upper engagement projection 54 reaches the intersection with the lateral offset cutout 96. Then the upper retainer cap 16" and the slotted transparent sleeve 84 are subsequently rotated opposite one another to slidably move the upper engagement projection 54 along the lateral offset cutout 96 and toward the seating area 98, as further illustrated in FIG. 16. Thereafter, the upper engagement projection 54 yieldingly remains engaged within the seating area 98 to selectively secure the upper retainer cap 16" to the slotted transparent sleeve 84. In this embodiment, the upper channel 50 is not required to flex outwardly to accommodate insertion of the slotted transparent sleeve 84 around the upper engagement projections 54. Therefore, the upper retainer cap can be made from a substantially rigid and inflexible material that may not permit outward flexing about the upper channel 50.

Likewise, the slotted transparent sleeve 84 may include the plurality of lower L-shaped slots 88 (FIG. 14) configured for similar engagement with the plurality of corresponding lower engagement projections 56 in the lower retainer cap 18". The lower retainer cap 18" may also optionally be manufactured from a substantially rigid and inflexible plastic material that does not permit outward flexing about the lower channel 52. To removably engage, the slotted transparent sleeve 84 and the lower retainer cap 18" are initially pressed axially together relative to one another such that the lower edge 92 engages the lower channel 52. With proper alignment, the lower engagement projection 56 also slidably extends into the longitudinal cutout 94 of the lower L-shaped slot 88 until the lower engagement projection 56 reaches the intersection with the lateral cutout 96. The lower retainer cap 18" and the slotted transparent sleeve 84 are then rotated opposite one another in a manner similar to that described above with respect to the upper retainer cap 16". This motion allows the lower engagement projections 56 to align with and slidably insert into the lateral offset cutouts 96 of lower L-shaped slots 88, and then subsequently slidably move along the lateral offset cutouts 96 until reaching the seating areas 98.

Removal of the upper and/or the lower retainer caps 16", 18" simply requires reversal of the motions described with respect to engagement above. Specifically, the upper and/or lower retainer caps 16", 18" can be removed by first rotating the retainer caps 16", 18" relative to the slotted transparent sleeve 84 in a direction opposite that of the initial engagement (e.g., opposite the directional arrow shown in FIG. 16), and then subsequently axially pulling the upper and/or the lower retainer caps 16", 18" apart from the slotted transparent sleeve 84 (e.g., opposite the directional arrow shown in FIG. 15), to facilitate disengagement of the upper and/or lower engagement projections 54, 56 from the L-shaped slots 86, 88. The selective removability of the upper and/or lower retainer caps 16", 18" allows for easy removal and replacement of the backlit film 12" for purposes of interchanging the image.

FIG. 14 illustrates that the backlit film 12" slidably resides within the interior of the slotted transparent sleeve 84 in a manner similar to that described above with respect to FIG. 12. The backlit film 12", when assembled, is located to the interior of the slotted transparent sleeve 84 in a manner best shown in FIG. 14. The backlit film 12" is configured to outwardly expand flush against the interior surface of the slotted transparent sleeve 84, as described above. In this respect, the slotted transparent sleeve 84 acts as a support that positions or carries the backlit film 12". In one embodiment, the upper and lower engagement projections 54, 56 may be configured to wholly or partially extend into the L-shaped slots 86, 88 in the slotted transparent sleeve 84, as best shown in FIGS. 15-16, only so much as to allow for flush mounting of the backlit film 12" against the interior of the slotted transparent sleeve 84. Like the slotted transparent sleeve 84, edges of the backlit film 12" may reside within the upper and/or lower channels 50, 52 in the upper and/or lower retainer caps 16", 18". In one embodiment, the backlit film 12" may be sandwiched between a portion of the upper channel 50 and a portion of the lower channel 52 upon engagement of the upper and lower engagement projections 54, 56 with the upper and lower L-shaped slots 86, 88, to prevent future movement of the backlit film 12" therein after assembly.

Another feature of the backlit ornament 10" shown with respect to FIG. 14 is the plug 48, which may be made from a rubber material. The plug 48 may insert into the upper retainer cap 16" and selectively receive the light source 24 and/or the base 22 in the manner described above with respect to FIG. 9. In one embodiment, the plug 48 may insert into the upper retainer cap 16" for non-rotatable compression and/or non-rotatable press-fit engagement therewith. In a similar manner, the plug 48 may selectively receive the light source 24 and/or the base 22 for similar non-rotatable compression and/or press-fit engagement therewith to secure the light source 24 in place. In this respect, upon insertion, retention, and/or connection of the light source 24 and the corresponding base 22 within the ornament 10", the light source 24 is thereafter fixed within the interior of the slotted transparent sleeve 84 and prevented from rotating relative to the plug 48, the upper retainer cap 16", and the slotted transparent sleeve 84. Non-rotatably engaging the light source 24 and/or the base 22 within the backlit ornament 10" may allow the light source 24 and/or the base 22 to be more snugly and securely retained within the backlit ornament 10", thereby reducing the likelihood that the light source 24 unintentionally becomes loose or separates after assembly.

Figure 17:
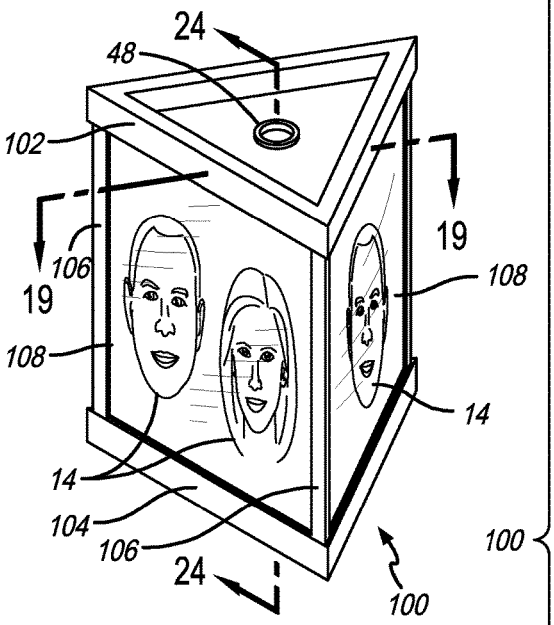
FIG. 17 is a perspective view of a triangular backlit ornament as disclosed herein.
Figure 18:
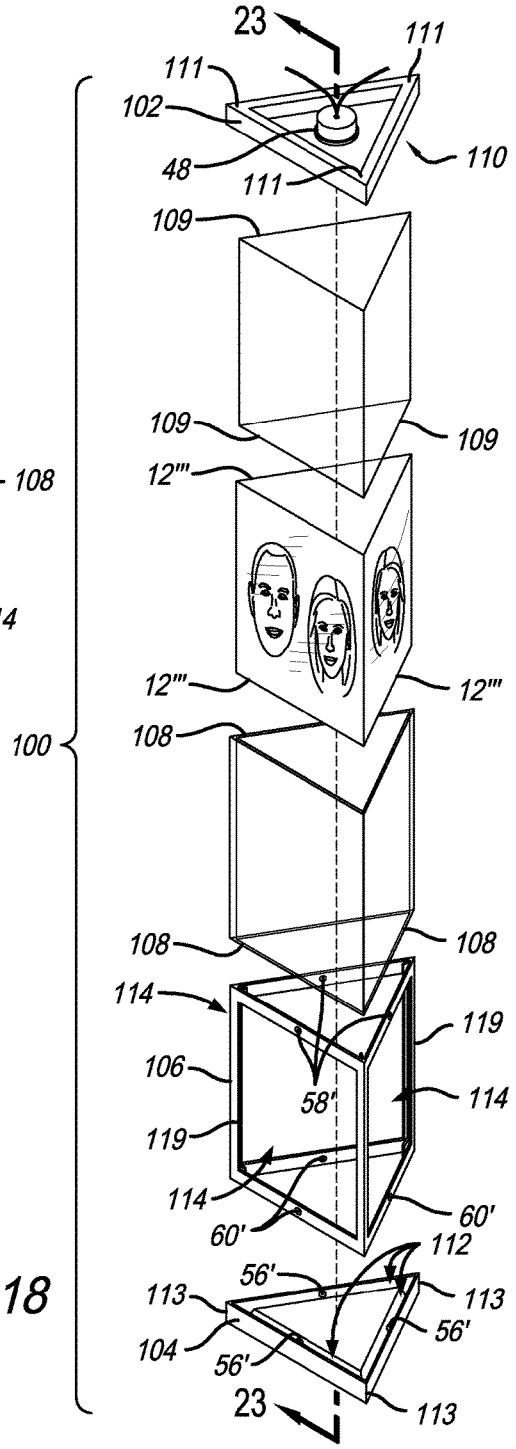
FIG. 18 is an exploded perspective view of the triangular backlit ornament of FIG. 17, further illustrating exploded arrangement of an external frame, a set of transparent outer lenses, a set of backlit films, and a set of transparent inner lens.
Figure 19:
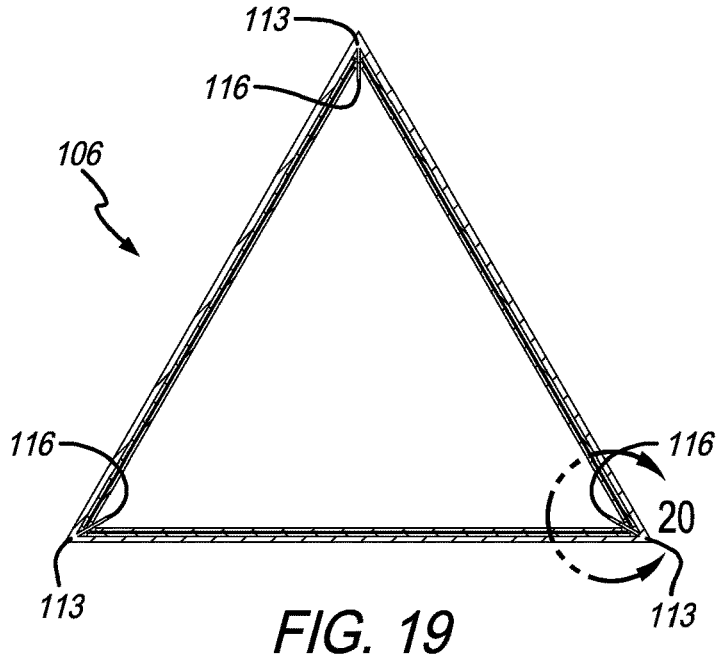
FIG. 19 is a cross-sectional view of the triangular backlit ornament taken about the section plane 19-19 in FIG. 17, further illustrating the external frame and a set of upper lens tabs.

Furthermore, FIGS. 17-25 illustrate an alternative embodiment of the ornament with a backlit film image as disclosed herein. More specifically, FIG. 17 is a perspective view of a triangular backlit ornament 100 (e.g., shown in generally triangular prismatic shape) and FIG. 18 is an exploded perspective view of the same. As shown, the triangular backlit ornament 100 includes a triangular upper retainer cap 102, a triangular lower retainer cap 104, and a triangular prismatic external frame 106. The triangular prismatic external frame 106 provides the outer structure for a set of three transparent outer lenses 108 arranged (interconnected or not) in a triangular configuration, a set of three backlit films 12'" having the images 14 thereon, and a set of three transparent inner lens 109 that sit flush with and provide backside support for the three backlit films 12'". More specifically, the triangular upper retainer cap 102 may include a triangular upper channel 110 that includes three straight channels that interconnect at a set of upper corners 111 and which form the triangular structure shown in FIGS. 17-19 and 21. Similarly, the triangular lower retainer cap 104 may include a triangular lower channel 112 also having three straight channels that interconnect into three lower corners 113 and which also facilitate forming the triangular structure shown in FIGS. 17-19 and 21. Each of the triangular upper and lower channels 110, 112 may be configured for respective slide-fit reception of the external frame 106. Additionally, the triangular upper and lower retainer caps 102, 104 may each include a respective series of upper and/or lower engagement projections 54', 56' configured to slidably engage one of a plurality of respective upper and/or lower apertures 58', 60' formed in the external frame 106. Engagement of the upper and/or lower apertures 58', 60' with the upper and/or lower engagement projections 54', 56' is described in more detail below with respect to FIG. 25.

Figure 31:
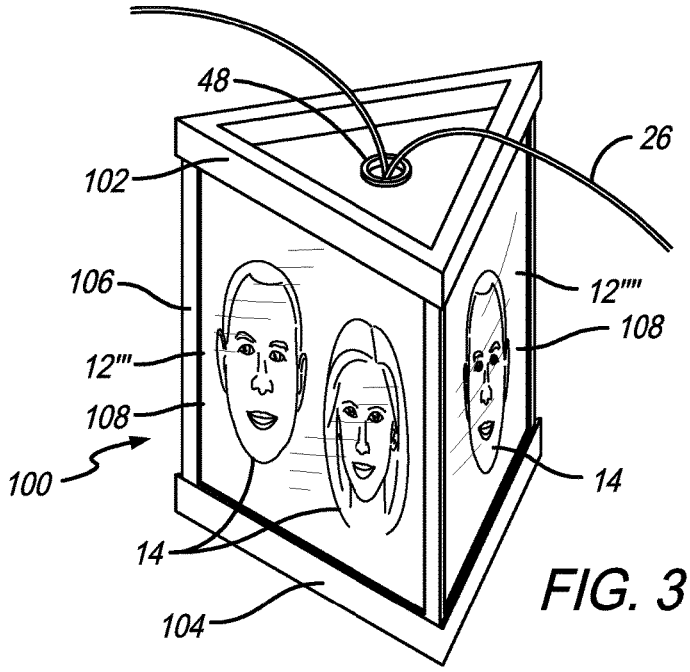
FIG. 31 is a perspective view illustrating the assembled triangular backlit ornament of FIGS. 17-25 or the alternative triangular backlit ornament of FIGS. 26-30 coupled to a light source on an elongated strand.
Figure 32:
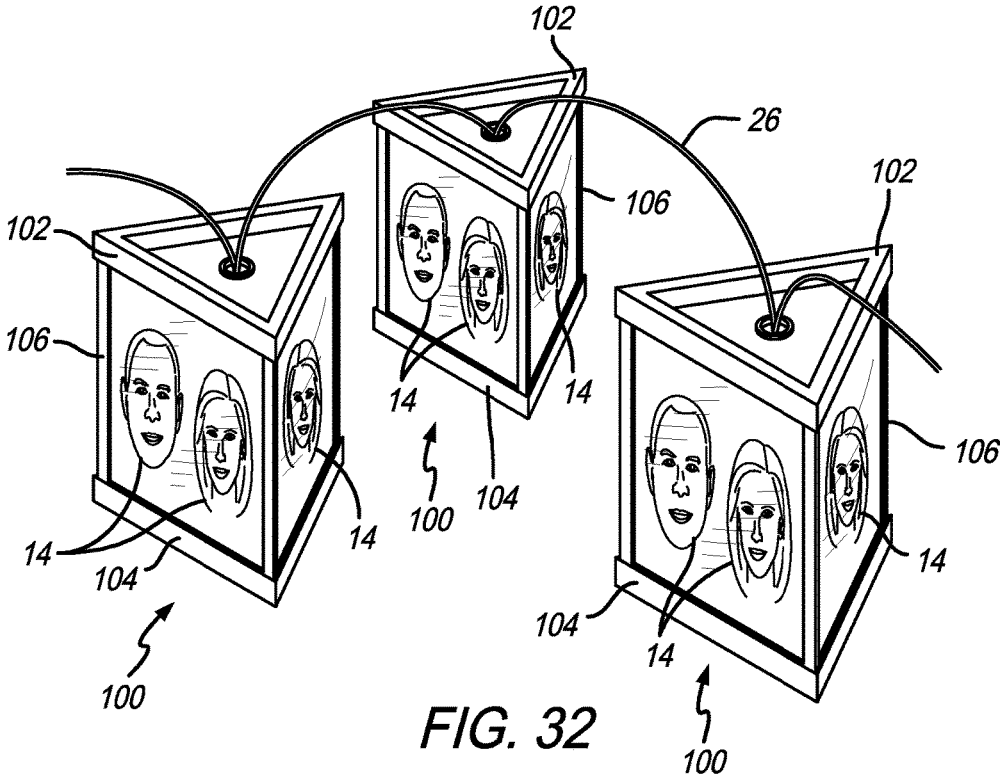
FIG. 32 is a perspective view illustrating multiple of the triangular backlit ornaments of FIGS. 17-25 and/or multiple of the alternative triangular backlit ornament of FIGS. 26-30, each coupled to a respective light source on the elongated strand.

In this embodiment, the external frame 106 may be generally formed from a somewhat rigid or hard plastic material configured to selectively support each of the transparent outer lenses 108 and each of the backlit films 12'" in an upright position. The external frame 106 may be made from a set of three generally flat and rectangular open frame sections 114 that together form the triangular prism structure of the frame 106, as shown in FIG. 18. Each of the open frame sections 114 forms a frame or window that permits viewing of the backlit films 12'" when placed flush behind the transparent outer lenses 108, e.g., as shown in FIGS. 31 and 32. Additionally in this respect, the external frame 106 may include a set of upper lens tabs 116 projecting inwardly from each of the upper corners 111 and/or the external frame 106 may include a set of lower lens tabs 118 projecting inwardly from each of the lower corners 113, as shown best with respect to the upper lens tab 116 in FIG. 20. To better support the transparent outer lenses 108, the backlit films 12'", and/or the inner transparent lenses 109, the external frame 106 may further include a vertical lens tab 119 that runs the vertical distance between the upper lens tab 116 and the lower lens tab 118, as shown best in FIGS. 18 and 22. In one embodiment, the upper and/or lower lens tabs 116, 118 project inwardly a greater distance than the vertical lens tabs 119. Although, in an alternative embodiment, the vertical lens tabs 119 could project inwardly the same distance or a greater distance than the upper and/or lower lens tabs 116, 118.

Figure 20:
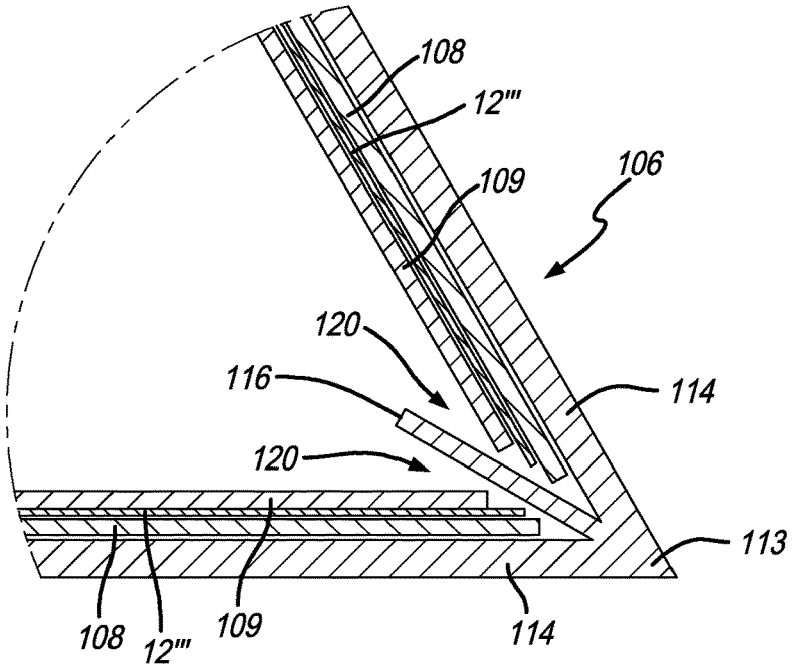
FIG. 20 is an enlarged cross-sectional view taken about the circle 20 in FIG. 19, further illustrating an upper lens tab retaining ends of a pair of transparent outer lenses, a pair of backlit films, and a pair of transparent inner lenses, with a set of open frame sections.
Figure 21:
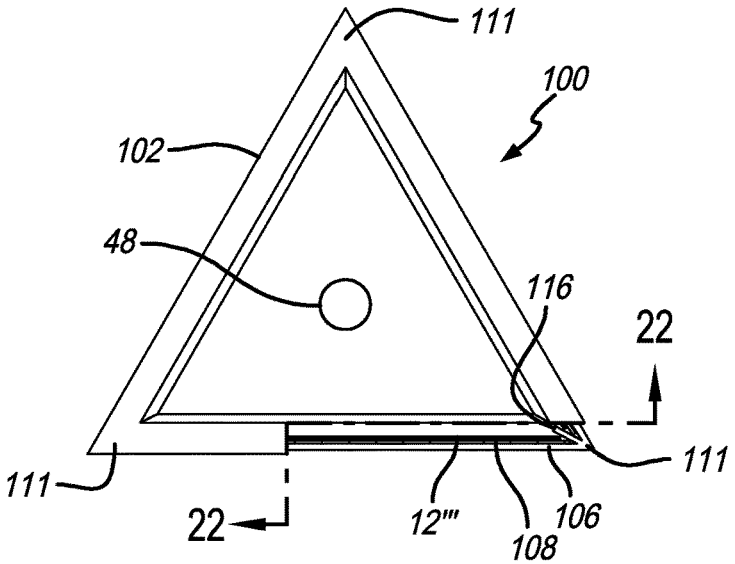
FIG. 21 is a top view of the triangular backlit ornament of FIG. 17 having a partial cutaway illustrating the upper lens tab retaining the transparent outer lens and the backlit film in flush engagement along the length of the external frame.
Figure 22:
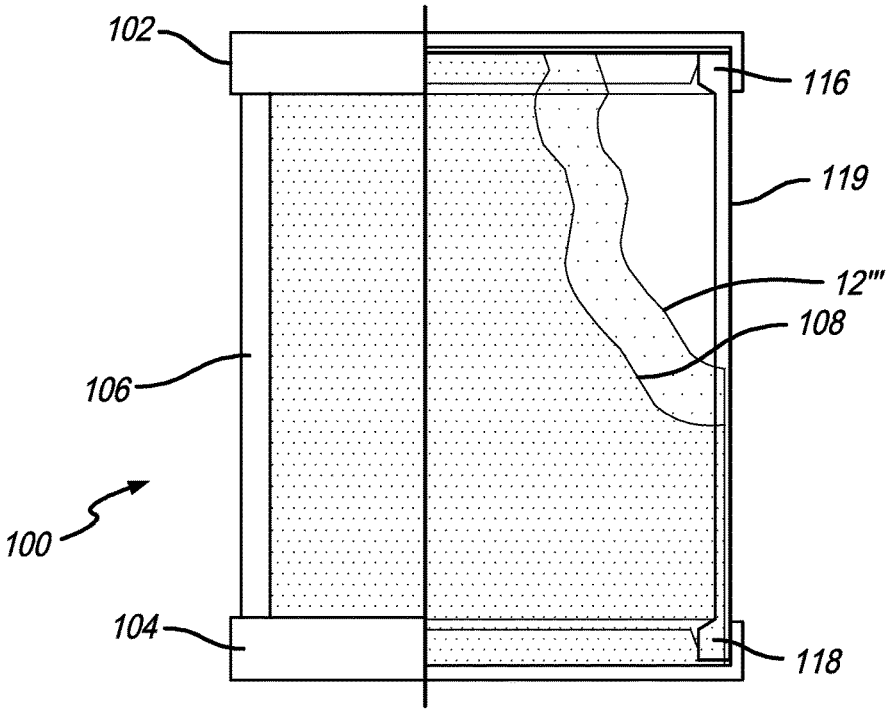
FIG. 22 is a side view of the triangular backlit ornament of FIG. 21 about the partial cutaway taken about the line 22-22 in FIG. 21, further illustrating the internally layered transparent outer lens and the backlit film.

The upper lens tabs 116, the lower lens tabs 118, and/or the vertical lens tabs 119 may be configured for slide-fit engagement with the transparent outer lenses 108, the backlit films 12'", and/or the transparent inner lenses 109. Specifically, the upper and lower lens tabs 116, 118 project inwardly at an angle (e.g., between 20 and 40 degrees) relative to the respective adjacent open frame sections 114 to form a pair of pinch points 120 therebetween, at each of the corners 111, 113, such as shown in FIG. 20. When engaged with the external frame 106, each of the transparent outer lenses 108 may be positioned flush against a smooth inner surface of the respective open frame section 114 and subsequently retained in place by the upper and lower lens tabs 116, 118 within the pinch point 120. Specifically, the outer corners and/or vertical edges of the transparent outer lenses 108 slide within the pinch points 120 in compression fit or pinched engagement between the upper and/or lower lens tabs 116, 118 (and optionally the vertical lens tabs 119) and the respective open frame section 114 (e.g., as best shown in FIG. 20). Likewise, each of the backlit films 12'" may subsequently be situated behind the respective transparent outer lenses 108 and retained in position by pinched engagement between the upper and/or lower lens tabs 116, 118 and the respective open frame section 114. Substantially the entire area of the flat top surface of each backlit film 12'", which may be smooth itself, can be positioned flush against the smooth inner surface of each respective transparent outer lens 108 at least in part because the transparent outer lenses 108 do not include any corrugations. In this respect, the transparent outer lenses 108 are generally formed from a somewhat rigid or hard plastic material that prevents the transparent outer lenses 108 from deforming and thereby coming loose from their respective positions in the pinch points 120 between the respective open frame section 114 and the upper and/or lower lens tabs 116, 118.

The external frame 106, the transparent outer lenses 108, the triangular upper retainer cap 102, and the triangular lower retainer cap 104 together form an enclosure forming the triangular backlit ornament 100 with the backlit film 12''' secured therein adjacent the transparent outer lens 108 and viewable out through the open frame sections 114.

In some embodiments, the transparent outer lenses 108 and the backlit films 12''' may be further retained in place by a respective transparent inner lens 109 positioned between the flat bottom surface of the backlit film 12''' and the upper and/or lower lens tabs 116, 118, as illustrated best in FIG. 20. Sandwiching the backlit films 12''' between the transparent outer lens 108 and the transparent inner lens 109 may help prevent movement of the backlit film 12''' should the triangular backlit ornament 100 move after assembly. Additionally, securing the backlit films 12''' between the transparent outer lenses 108 and the transparent inner lenses 109 may obviate the need for the backlit films 12''' to engage with the respective upper and/or lower lens tabs 116, 118, thereby allowing the backlit films 12''' to be sized in various shapes that do not require extension into the pinch points 120 (e.g., non-rectangular shapes such as a star or circle). Such an embodiment may also reduce wear on the backlit films 12''' by preventing rubbing against the upper and/or lower lens tabs 116, 118. Here, at least the outer corners of the transparent outer lens 108 and the transparent inner lens 109 engage the upper lens tab 116 and the lower lens tab 118. Optionally, the vertical edges of the transparent outer lens 108 and the transparent inner lens 109 may engage the vertical lens tabs 119. In this respect, the backlit films 12''' may be completely encapsulated between the transparent outer lens 108 and the transparent inner lens 109.

Figure 23:
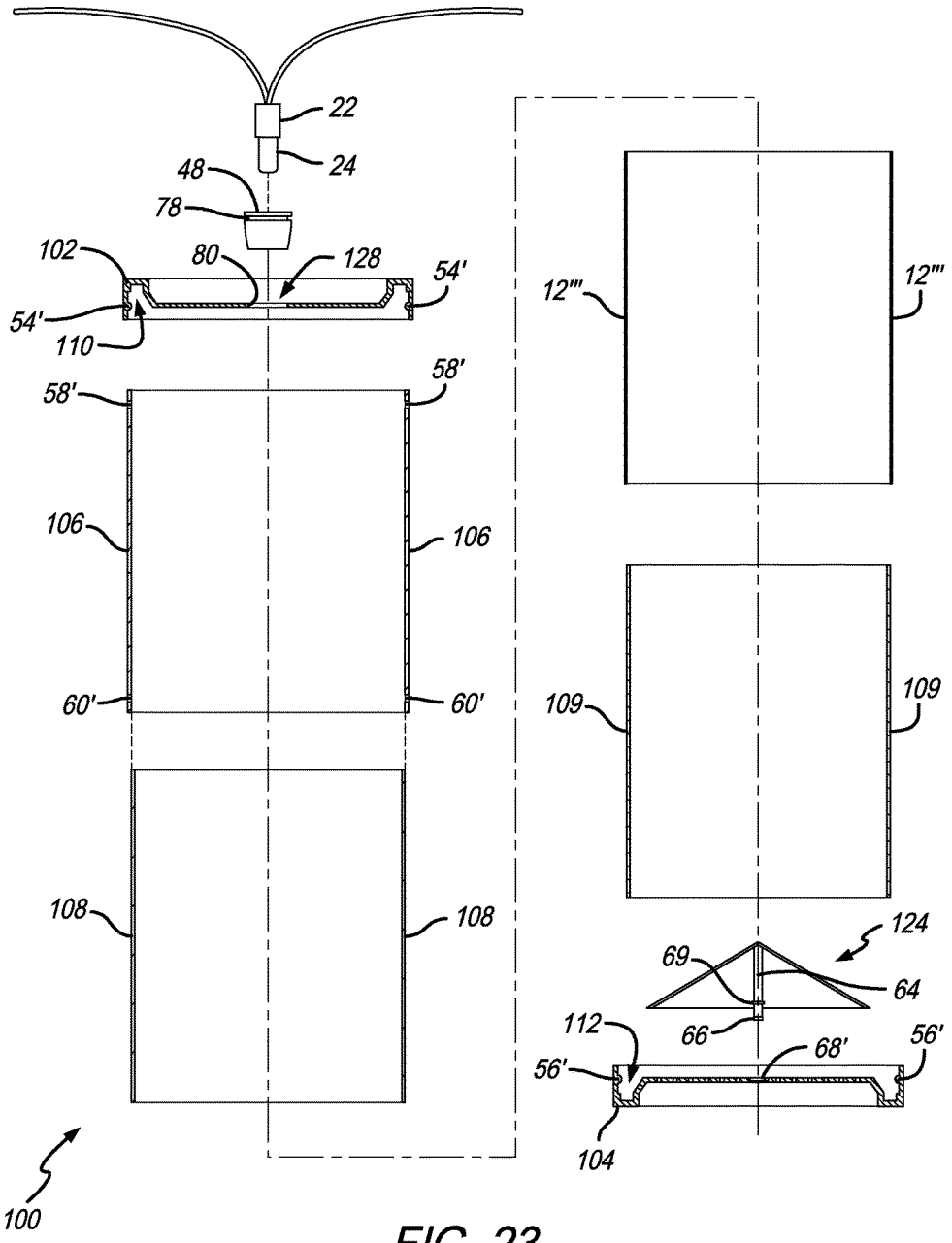
FIG. 23 is an exploded cross-sectional view of the triangular backlit ornament taken about the section plane 23-23 in FIG. 18, further illustrating a non-rotatable plug selectively insertable into a triangular upper retainer cap and a triangular domed reflector in a triangular lower retainer cap.
Figure 24:
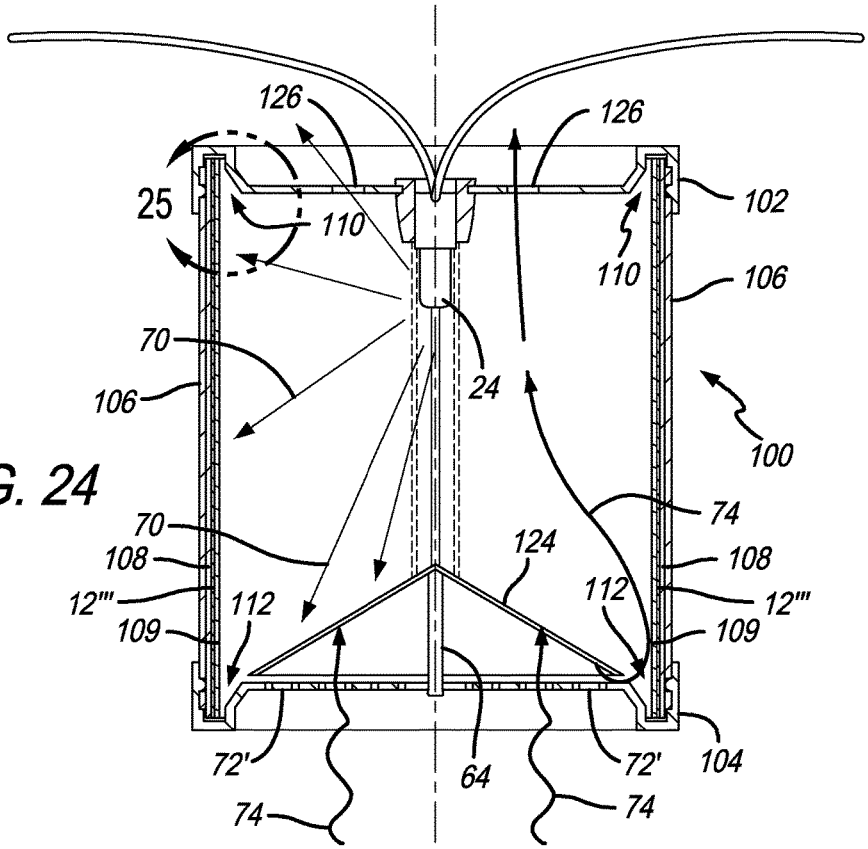
FIG. 24 is a cross-sectional view of the triangular backlit ornament taken about the section plane 24-24 in FIG. 17, further illustrating a light source engaged in non-rotatable relation relative to the triangular upper retainer cap and disposed above a light dispersing triangular domed reflector.

FIGS. 23 and 24 are cross-sectional views of the triangular backlit ornament 100 optionally including a triangular domed reflector 124 formed generally in the shape of a triangular pyramid and including the extension 64 with the flared end 66 configured to snap-fit or press-fit engage a retaining aperture 68' in the triangular lower retainer cap 104. The diameter of the retaining aperture 68' may be approximately the same diameter as the outer diameter of the extension 64. In this respect, the diameter of the retaining aperture 68' may be somewhat slightly larger than the outer diameter of the extension 64 to facilitate slide-fit reception thereof. The flared end 66 can be sized to slidably extend through the retaining aperture 68' yet wide enough to retain the triangular domed reflector 124, as generally shown in FIG. 24, to the triangular lower retainer cap 104. Once inserted, the triangular domed reflector 124 remains affixed as the flared end 66 and the stop collar 69 sandwiches a portion of the triangular lower retainer cap 104 therebetween. Here, the triangular domed reflector 124 is removably affixed to the triangular lower retainer cap 104. Removal simply requires pulling the extension 64 and the flared end 66 back through the retaining aperture 68'. Alternatively, the triangular domed reflector 124 may be temporarily or permanently adhesively or mechanically attached (e.g., screwed or nailed) to the triangular lower retainer cap 104.

Use of the triangular domed reflector 124 reduces light fall-off through the bottom of the triangular backlit ornament 100 and serves as a baffle for ventilation holes. Additionally, it may also be desirable to couple another triangular domed reflector (not shown) to the triangular upper retainer cap 102. Of course, such an upper triangular domed reflector would need to facilitate extension of the light source 24 therethrough. FIG. 24 more specifically illustrates the series of light waves 70 emitted from the light source 24 reflecting off the triangular domed reflector 124 for redirection into the backlit films 12'''. The interior surface of the triangular domed reflector 124 can be made from or coated with a reflective material to help facilitate such reflection. Additionally, FIG. 24 further illustrates a plurality of ventilation apertures 72' in the triangular lower retainer cap 104 allowing the coolant waves 74 to enter into the enclosure of the triangular backlit ornament 100, to proceed around the triangular domed reflector 124, and exit out through the a series of upper ventilation apertures 126 formed in the triangular upper retainer cap 102. The ventilation apertures 72', 126 facilitate airflow through the interior of the triangular backlit ornament 100 so the triangular backlit ornament 100 is capable of convective cooling throughout the interior of the enclosure.

Figure 25:
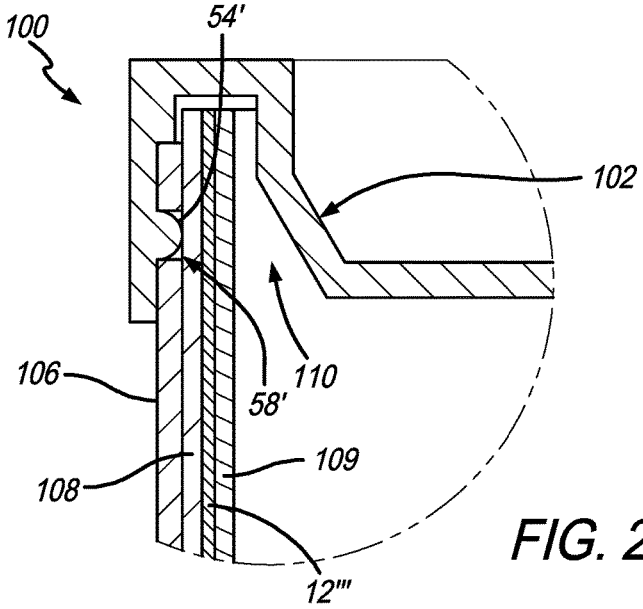
FIG. 25 is an enlarged cross-sectional view taken about the circle 25 in FIG. 24, further illustrating snap-fit reception of the triangular upper retainer cap with the external frame.

FIG. 25 is an enlarged cross-sectional view of the triangular backlit ornament 100, further illustrating engagement of the triangular upper retainer cap 102 with the external frame 106. More specifically, FIG. 25 illustrates one of the upper engagement projections 54' extending into the triangular upper channel 110 and into engagement with one of the upper apertures 58' in the external frame 106, such that the triangular upper retainer cap 102 removably engages the external frame 106. Multiple of the upper apertures 58' may be disposed at intermittent intervals (e.g., equidistant intervals) or at distinct locations (e.g., near the upper and/or lower corners 111, 113) in the external frame 106 and configured for slide-fit or snap-fit engagement with the corresponding upper engagement projections 54' disposed at similar intervals about the interior of the triangular upper channel 110 of the triangular upper retainer cap 102. Accordingly, each of the upper engagement projections 54' may engage the respective upper apertures 58' to ensure the triangular upper retainer cap 102 remains substantially affixed to the external frame 106. The triangular upper retainer cap 102 may be made from a substantially resilient and lightweight plastic material that permits outward flexing of the triangular upper channel 110. This allows for enlargement of the triangular upper channel 110 to facilitate insertion of the external frame 106 therein, such that the upper engagement projection 54' may slidably insert into and engage the upper aperture 58'. Once engaged, the triangular upper retainer cap 102 (e.g., made from the resilient plastic material) may retain its shape substantially as shown in FIG. 25. Here, the flat top surface of the backlit film 12''' is positioned flush against the smooth inner surface of the transparent outer lens 108 and the flat bottom surface of the backlit film 12''' is positioned flush against the smooth outer surface of the transparent inner lens 109.

Likewise, the external frame 106 may include the plurality of lower apertures 60' (FIG. 18) configured for slide-fit or snap fit engagement with the plurality of corresponding lower engagement projections 56' in the triangular lower retainer cap 104. The triangular lower retainer cap 104 can also be manufactured from a substantially resilient yet flexible plastic material that allows for enlargement of the triangular lower channel 112 upon desired insertion of the external frame 106 therein. In this respect, the triangular lower channel 112 may flex outwardly to accommodate insertion of the external frame 106 beyond the lower engagement projections 56' for slide-fit or press-fit engagement with the corresponding lower apertures 60'. Once engaged, the substantially resilient plastic material recovers back to its preferred shape as shown, e.g., in FIG. 25 with respect to the triangular upper retainer cap 102 and its corresponding triangular upper channel 110.

Removal of the upper engagement projections 54' from the upper apertures 58' may require flexing the triangular upper retainer cap 102 outwardly, thereby expanding the triangular upper channel 110 to facilitate disengagement of the projections 54' from the apertures 58'. The same may be true with respect to disengagement of the lower engagement projections 56' from the lower apertures 60', namely, the triangular lower retainer cap 104 may be flexed outwardly, thereby expanding the triangular lower channel 112, to facilitate disengagement of the projections 56' from the apertures 60'.

In an alternative embodiment, the external frame 106, the transparent outer lenses 108, the backlit films 12''', and/or the transparent inner lenses 109 may be permanently affixed to each of the triangular upper retainer cap 102 and/or the triangular lower retainer cap 104 by disposing an adhesive (not shown) in each of the respective triangular upper and/or lower channels 110, 112. The adhesive may bond respective portions of the external frame 106, the transparent outer lenses 108, the backlit films 12''', and/or the transparent inner lenses 109 to the upper and/or lower retainer caps 102, 104. This embodiment may be more robust as it is not meant for disassembly.

In further embodiments of the triangular backlit ornament 100, the external frame 106 can be formed integrally with the triangular upper or lower retainer caps 102, 104 to create a unitary external frame. Here, the unitary external frame can be a single or unitary part having the three open frame sections 114 formed together with the triangular upper or lower retainer cap 102, 104. Integrating the triangular upper or lower retainer cap 102, 104 with the open frame sections 114 to form the unitary external frame reduces the number of parts needed to form the triangular backlit ornament 100 and allows for a simpler design. Furthermore, the unitary external frame may be more rigid, thereby stabilizing the structure relative to other designs.

Another feature of the triangular backlit ornament 100 shown with respect to FIG. 23 is the plug 48, which can be made from a rubber material. The plug 48 inserts into the triangular upper retainer cap 102 for compression and/or press-fit engagement therewith. In a similar manner, the plug 48 may selectively receive the light source 24 and/or the base 22 for compression and/or press-fit engagement therewith to affix the light source 24 in place. In this respect, the plug 48 may further include the aforementioned engagement channel 78 that selectively engages the flange 80 formed from a portion of the triangular upper retainer cap 102 adjacent an engagement aperture 128. The plug 48 may selectively snap into or be removed from the triangular upper retainer cap 102, as needed. In one embodiment, the plug 48 may include a plurality of the flexible insertion flaps 82, similar to those shown in FIG. 13, capable of flexing to receive the aforementioned base 22 and/or the light source 24 by friction-fit reception. The insertion flaps 82 may operate in a manner similar to the aforementioned X-slit 20 described with respect to the embodiments above. Of course, a person of ordinary skill in the art will readily recognize that there may be many different ways of facilitating insertion, retention, and/or connection of the light source 24 (and possibly the corresponding base 22) into the interior of the triangular backlit ornament 100 to accomplish backlit lighting of the backlit films 12'''.

The removable aspect of the plug 48 allows the triangular backlit ornament 100 to be used with different lighting fixtures. For example, instead of slide-fit reception of the base 22 and the light source 24, the plug 48 may be made as part of a pre-formed combination light source and plug. Here, the plug/light source simply attach to the triangular backlit ornament 100 through snap-fit or press-fit engagement of the engagement channel 78 with the flange 80. This embodiment may be used with the aforementioned elongated strand 26, such as for use in stringing multiple ornaments 100 in association with the Christmas tree strand as shown in FIG. 32.

In an alternative embodiment, the plug 48 may insert into the triangular upper retainer cap 102 for non-rotatable compression and/or non-rotatable press-fit engagement therewith. In a similar manner, the insert or plug 48 may selectively receive the light source 24 and/or the base 22 for similar non-rotatable compression and/or non-rotatable press-fit engagement therewith to secure the light source 24 in place. In this respect, upon insertion, retention, and/or connection of the light source 24 (and possibly the corresponding base 22), the light source 24 is thereafter fixed within the interior of the triangular backlit ornament 100 and not permitted to rotate relative to the insert or plug 48, relative to the triangular upper retainer cap 102, or relative to the external frame 106. Non-rotatable engagement of the light source 24 and/or the base 22 within the triangular backlit ornament 100 may allow the light source 24 and/or the base 22 to be more snugly and securely retained within the triangular backlit ornament 100, thereby reducing the likelihood that the light source 24 unintentionally becomes loose or separates after assembly.

Additionally, FIGS. 26-30 illustrate an alternative embodiment of a triangular backlit ornament 100' having an internal frame 130 that operates with an alternative external frame 106' to support the transparent outer lenses 108, the backlit films 12''', and/or the transparent inner lenses 109 in a supportive upright position with the triangular upper and lower retainer caps 102, 104, as opposed to the upper lens tabs 114, the lower lens tabs 118, and/or the vertical lens tabs 119. The alternative external frame 106' is similar to the external frame 106 described above with respect to FIGS. 17-25, namely the external frame 106' includes comparable upper and lower engagement apertures 58', 60' that are configured to selectively engage respective upper and lower engagement projections 54', 56' in the upper and lower retainer caps 102, 104, as shown and described above with respect to FIG. 25. Although, in this embodiment, the upper and lower channels 110, 112 should be wide enough to accommodate insertion of the internal frame 130 as well.

Figure 27:
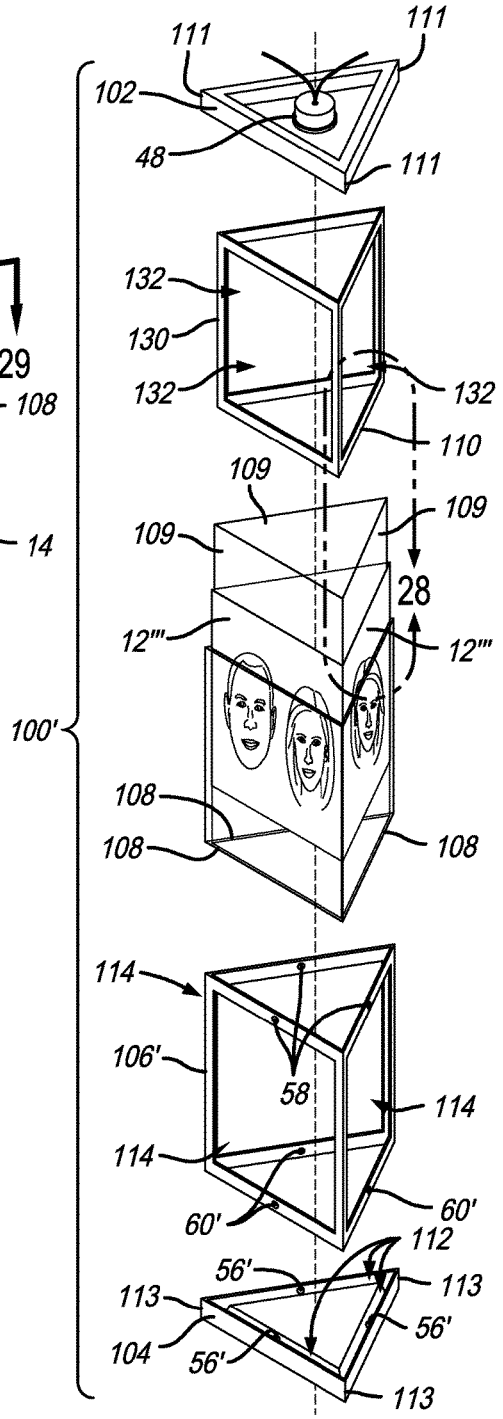
FIG. 27 is an exploded perspective view of the alternative triangular backlit ornament of FIG. 26, further illustrating the external frame cooperating with an additional internal frame to support the set of transparent outer lenses, the set of backlit films, and the set of transparent inner lenses.
Figure 28:
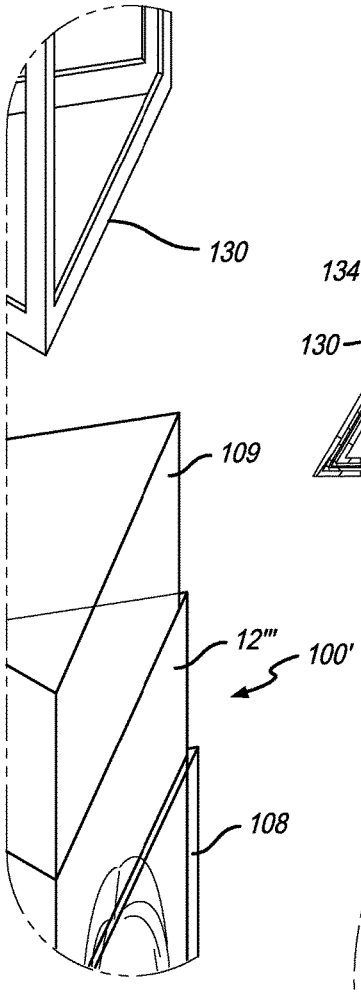
FIG. 28 is an enlarged exploded perspective view of the alternative triangular backlit ornament taken about the oval 28 in FIG. 27, further illustrating relative arrangement of the internal frame, the transparent outer lenses, the backlit films, and the transparent inner lenses.

The exploded perspective view of FIG. 27 more specifically illustrates the relative structural layered relationship of the external frame 106' relative to the transparent outer lenses 108, the backlit films 12''', the transparent inner lenses 109, and the internal frame 130. More specifically, the internal frame 130 is generally formed from a somewhat rigid or hard plastic material, similar to the external frame 106 (FIGS. 17-25) and/or the alternative external frame 106', and is configured to brace at least the backlit films 12''' against the transparent outer lenses 108, and the transparent outer lenses 108 against the open frame sections 114 in the supportive upright position. The internal frame 130 is shown made from a set of three generally flat and rectangular open frame sections 132 that together form the triangular prism structure of the internal frame 130. Each of the open frame sections 132 includes a generally rectangular frame structure forming open windows therein that permit transmission of the light waves 70 (such as those shown and described above with respect to FIG. 24) to pass therethrough and illuminate the backlit films 12''' upon insertion of a light source (e.g., the light source 24) within the enclosure of the alternative triangular backlit ornament 100'.

FIG. 27 illustrates the alternative triangular backlit ornament 100' having each of the external frame 106, the transparent outer lenses 108, the backlit films 12''', the transparent inner lenses 109, and the internal frame 130. Although, in alternative embodiments, it may be possible to provide a supportive upright structure for the backlit films 12''' using various combinations of the external frame 106, the transparent outer lenses 108, the backlit films 12''', the transparent inner lenses 109, and the internal frame 130, including: (a) the external frame 106 with the backlit films 12''' and the internal frame 130; (b) the external frame 106 with the transparent outer lenses 108, the backlit films 12''', and the internal frame 130; or (c) the external frame 106 with the backlit films 12''', the transparent inner lenses 109, and the internal frame 130. In this respect, in each of these embodiments, each of the external frame 106, the transparent outer lenses 108, the backlit films 12''', the transparent inner lenses 109, and/or the internal frame 130 may be configured for relative slide-in reception and flush engagement with each other. For example, with respect to the embodiment shown with respect to FIG. 27, the inside surfaces of the open frame sections 114 selectively receive for flush engagement against the outer periphery of each of the flat transparent outer lenses 108. Similarly, the flat inner surfaces of the transparent outer lenses 108 are configured for flush engagement with the flat exterior surface of the backlit films 12''', which also include flat inner surfaces for flush engagement with the flat outer surface of the transparent inner lenses 109. Similar to the alternative external frame 106', the outer surfaces of the open frame sections 132 of the internal frame 130 are configured for flush engagement along the flat or smooth outer peripheral surfaces of the transparent inner lenses 109. The relative flush placement of each of the transparent outer lenses 108, the backlit films 12''', the transparent inner lenses 109, and the internal frame 130 are shown with respect to FIG. 28.

Figure 29:
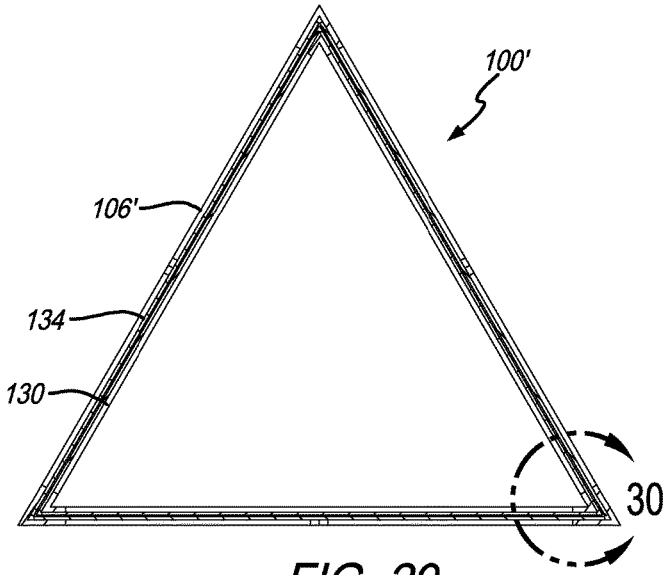
FIG. 29 is a cross-sectional view of the alternative triangular backlit ornament taken about the section plane 29-29 in FIG. 26, further illustrating relative concentric arrangement the external frame relative to the internal frame.
Figure 30:
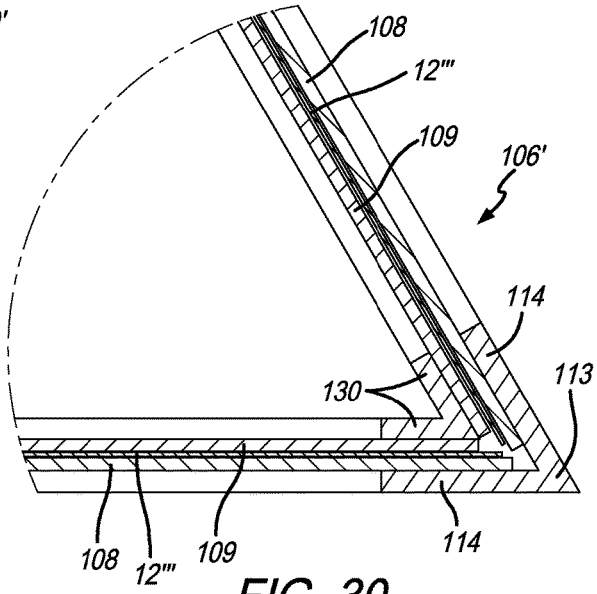
FIG. 30 is an enlarged cross-sectional view of the alternative triangular backlit ornament taken about the circle 30 in FIG. 29, further illustrating retention of the transparent outer lenses, the backlit films, and the transparent inner lenses between the external frame and the internal frame.

FIGS. 29-30 are cross-sectional views further illustrating the relative positioning and arrangement, including the aforementioned flush engagement, of the alternative external frame 106', the transparent outer lenses 108, the backlit films 12''', the transparent inner lenses 109, and the internal frame 130. FIG. 29 illustrates one embodiment taken through a cross-section of the triangular upper retainer cap 102 wherein the transparent outer lenses 108, the backlit films 12''', and/or the transparent inner lenses 109 are not of a size to extend up therein, such as into the upper channel 110. Here, FIG. 29 illustrates that the alternative external frame 106' and the internal frame 130 sandwich the transparent outer lenses 108, the backlit films 12''', and/or the transparent inner lenses 109 therebetween. Although, of course, one or more of the transparent outer lenses 108, the backlit films 12''', and/or the transparent inner lenses 109 may extend up into the upper channel 110. In these alternative embodiments, one or more of the transparent outer lenses 108, the backlit films 12''', and/or the transparent inner lenses 109 would be represented in cross-section hatching. As shown, the internal frame 130 is relatively smaller than the external frame 106', which allows the internal frame 130 to be situated concentrically therein to define a gap 134 in between for slide-in reception of the transparent outer lenses 108, the backlit films 12''', and/or the transparent inner lenses 109 sandwiched therein.

In some embodiments, the external frame 106' and the internal frame 130 may be a single piece (e.g., a unitary construction) wherein the respective transparent outer lenses 108, the backlit films 12''', and/or the transparent inner lenses 109 can selectively slide therein.

Figure 26:
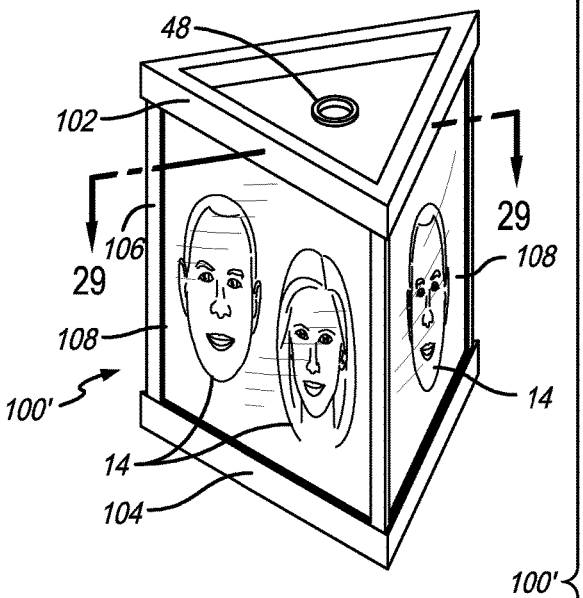
FIG. 26 is a perspective view of an alternative triangular backlit ornament as disclosed herein.

In another alternative embodiment, the continuous open space or gap 134 formed between the concentrically situated external frame 106' and the internal frame 130 may be configured for select slide in reception of a single or unitary backlit film having a single continuous sheet construction (similar to that shown in FIG. 5), as opposed to the multiple separate backlit films 12''' as shown in FIGS. 26 and 27. The single or unitary backlit film can be formed or cut to a length that allows the backlit film to be manipulated for insertion into the gap 134, and possibly between the transparent outer and inner lenses 108, 109 (when used). In further embodiments, the transparent outer lenses 108 and/or the transparent inner lenses 109 can similarly be formed as a single, unitary structure (e.g., a foldable sheet or single rigid triangular structure) for insertion into the open space or gap 134. These embodiments may require the manufacture and/or assembly of fewer parts and may enhance the rigidity of the assembled alternative triangular backlit ornament 100'.

FIG. 30 is a cross-sectional view of the alternative triangular backlit ornament 100' within one of the lower corners 113. More specifically, FIG. 30 further illustrates the transparent outer lenses 108 in flush engagement behind the open frame sections 114 of the alternative external frame 106'. Accordingly, the backlit films 12''' are flush behind the transparent outer lenses 108 on one side and flush in front of the transparent inner lenses 109 on the other side. The internal frame 130 provides forward sandwiching engagement behind the transparent inner lenses 109 for forward engagement into the open frame sections 114. Thus, the transparent outer lenses 108, the backlit films 12''', and/or the transparent inner lenses 109 can be sandwiched between the alternative external frame 106' and the internal frame 130. In this way, the transparent outer lenses 108, the backlit films 12''', and/or the transparent inner lenses 109 are secured within the alternative triangular backlit ornament 100'. The internal frame 130 may be substantially the same height as the alternative external frame 106' so that the internal frame 130 cooperates with the alternative external frame 106' to sandwich the transparent outer lenses 108, the backlit films 12''', and/or the transparent inner lenses 109 within each of the upper and/or lower channels 110, 112 of the upper and/or lower retainer caps 102, 104.

Persons skilled in the art will recognize and appreciate that the triangular shape of the triangular backlit ornaments 100, 100' can be provided in virtually any desired polygonal configuration, including but not limited to rectangles, trapezoids, pentagons, hexagons, and other polygons and the like. Additionally, the backlit films 12''' can be flexible and at least substantially smooth on each side such that the backlit films 12''' sit flush with the surface area of the transparent outer lenses 108 and/or the transparent inner lenses 109 substantially along their entire surface area. In this respect, the backlit films 12''' may have a consistent thickness throughout their entire surface area, which means the backlit films 12''' are free of projections, lumps, indentations, etc.

Figure 33:
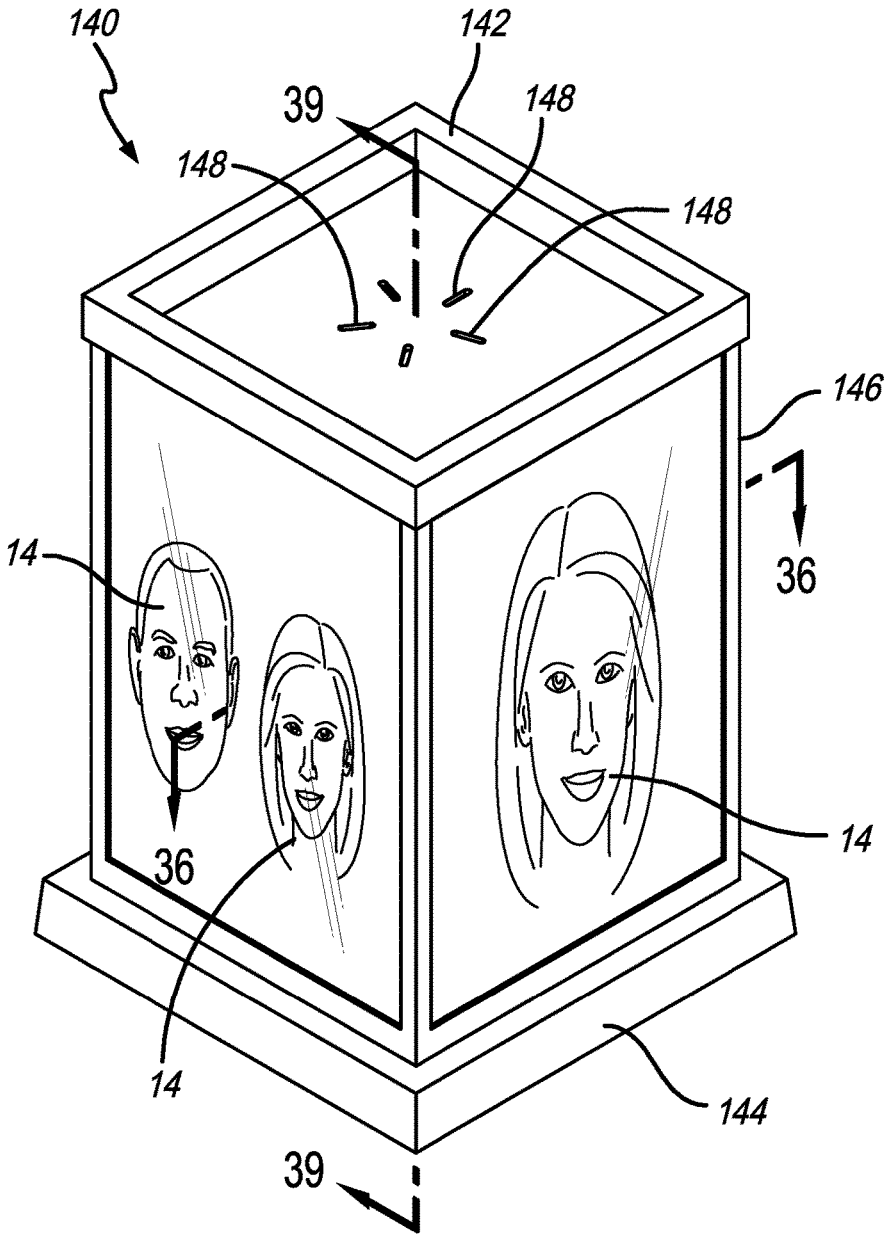
FIG. 33 is a perspective view of a rectangular backlit ornament as disclosed herein.

Furthermore, FIGS. 33-41 illustrate another alternative embodiment of a rectangular backlit ornament 140 capable of carrying or otherwise supporting one or more of the backlit film images, as disclosed herein. The embodiments disclosed with respect to FIGS. 33-41 (and with respect to FIGS. 42-45) may be placed on a support surface, such as a table top (e.g., as a centerpiece) or the like. More specifically, FIG. 33 is a perspective view of the rectangular backlit ornament 140 having a rectangular upper retainer cap 142 and a rectangular base 144 that snap together with an external rectangular frame 146 to form the enclosure shown in FIG. 33. The external rectangular frame 146 provides the outer structure for selectively receiving and retaining multiple of the transparent outer lenses 108 arranged (interconnected or not) in a rectangular configuration. These transparent outer lenses 108, as disclosed herein and in more detail below, cooperate to support one or more of the backlit films 12''' having the images 14 thereon in an upright position for viewing of the images 14 through the transparent outer lenses 108. In this embodiment, the external rectangular frame 146 is configured to selectively receive and retain four separate assemblies of the transparent inner outer lenses 108, the backlit films 12''', and the transparent inner lenses 109. Moreover, FIG. 33 also illustrates that the rectangular upper retainer cap 142 includes a plurality of vents 148 formed therein to help facilitate convection cooling therein, especially when the rectangular backlit ornament 140 is used with a light source that generates heat within the inside of the enclosure.

Figure 34:
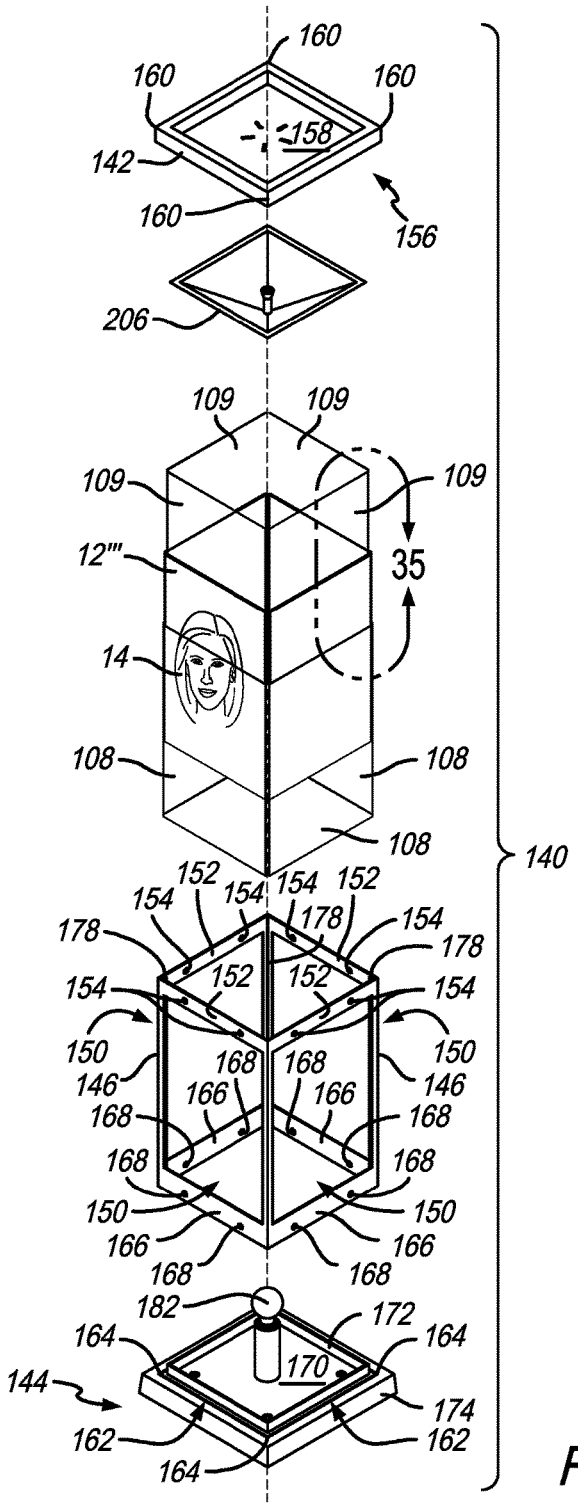
FIG. 34 is an exploded perspective view of the rectangular backlit ornament of FIG. 33, further illustrating exploded arrangement of an external rectangular frame, the set of transparent outer lenses, the set of backlit films, and the set of transparent inner lens.
Figure 35:
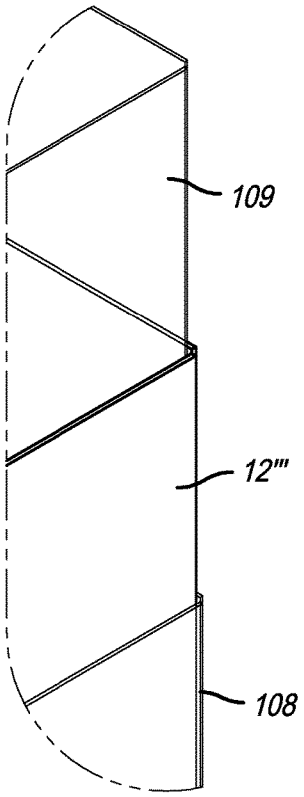
FIG. 35 is an enlarged exploded perspective view of the rectangular backlit ornament taken about the oval 35 in FIG. 34, further illustrating relative arrangement of the transparent outer lenses, the backlit films, and the transparent inner lenses.

FIG. 34 is an exploded perspective view of the rectangular backlit ornament 140 illustrated with respect to FIG. 33. More specifically, FIG. 34 illustrates the external rectangular frame 146 in exploded relation relative to the transparent outer lenses 108, the set of backlit films 12''' (one having the image 14 thereon), and the transparent inner lenses 109. As discussed above, the transparent outer lenses 108 and the transparent inner lenses 109 cooperate to encapsulate the backlit films 12''' to support the backlit films 12''' in an upright position for viewing of the images 14 thereon. As above, the external rectangular frame 146 may be generally formed from a somewhat rigid or hard plastic material configured to selectively support each of the transparent outer lenses 108, each of the backlit films 12''', and each of the transparent inner lenses 109 in the upright position shown, e.g., in FIGS. 33 and 41. The relative flush placement of the transparent outer lenses 108, the backlit film 12''', and the transparent inner lens 109 is shown with respect to FIG. 35.

The external rectangular frame 146 may be made from a set of four generally flat and rectangular open frame sections 150 that together form the rectangular structure of the frame 146, as shown in FIG. 34. Each of the open frame sections 150 form a frame or window that permits viewing of the backlit films 12''' and the images 14 thereon when placed flush behind the transparent outer lenses 108, e.g., as shown in FIG. 33. Each upper horizontal frame member 152 includes a plurality of upper connecting apertures 154 (e.g., two for each horizontal frame member 152, as shown in FIG. 34) that are configured for select slide-fit or snap-fit engagement with a corresponding detent (e.g., as shown in FIG. 25) formed from or otherwise projecting into a rectangular upper channel 156 formed from the rectangular upper retainer cap 142. The rectangular upper channel 156 is generally formed from four straight channels that interconnect up underneath a top surface 158 of the rectangular upper retainer cap 142 at a respective set of upper rectangular corners 160, and which generally form the rectangular structure shown in FIGS. 33-34, 36, 38, and 41. The rectangular upper channel 156 is preferably of a size approximately the width of each of the upper horizontal frame members 152, each of which may be the same size or vary in size as needed and/or desired. Similarly, the rectangular base 144 may include a rectangular lower channel 162 made up from four straight channels that interconnect into four lower rectangular corners 164. The rectangular lower channel 162 may be of a size and shape for select slide-in reception of a set of lower horizontal frame members 166 each including multiple lower connecting apertures 168 configured for snap-fit engagement with an inwardly projecting detent (e.g., those shown with respect to FIG. 25) positioned within the interior of the rectangular lower channel 162.

In this embodiment, and as best shown in FIGS. 33-34, 36, and 41, the rectangular base 144 includes a generally inner horizontal support surface 170 that includes a generally upstanding base lens tab 172 (e.g., formed integral with the rectangular base 144) positioned near an outer perimeter of the support surface 170, but to the interior of the rectangular lower channel 162. The rectangular lower channel 162 is formed into the support surface 170 outside of the upstanding base lens tab 172 and the two cooperate together to provide interior and exterior stability to the external rectangular frame 146 when connected to the rectangular base 144. The exterior perimeter of the support surface 170 then extends downwardly around an outer perimeter into a skirt 174 that may provide additional stabilization for the rectangular backlit ornament 140 given that the skirt 174 terminates in an area relatively larger than the rectangular lower channel 162 that selectively receives and retains the external rectangular frame 146. Additionally, with respect to FIG. 34, the support surface 170 is shown supporting a battery powered light 176, as described in more detail below.

Figure 36:
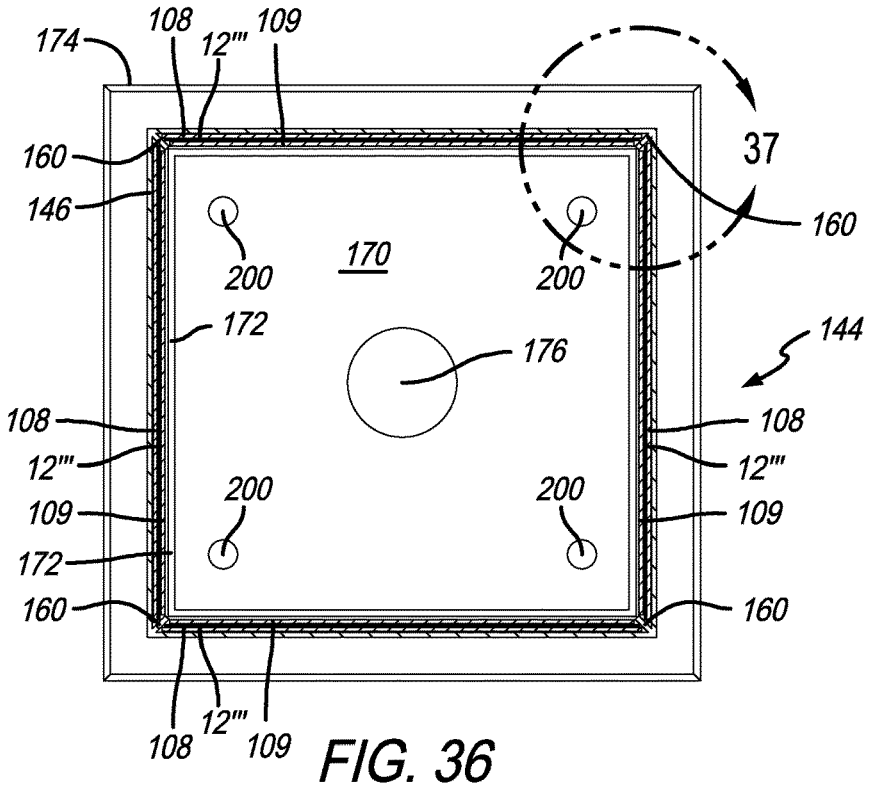
FIG. 36 is a cross-sectional view of the rectangular backlit ornament taken about the section plane 36-36 in FIG. 33, further illustrating relative positioning of the external rectangular frame, the set of upper lens tabs, the set of backlit films, and the transparent inner lenses.
Figure 37:
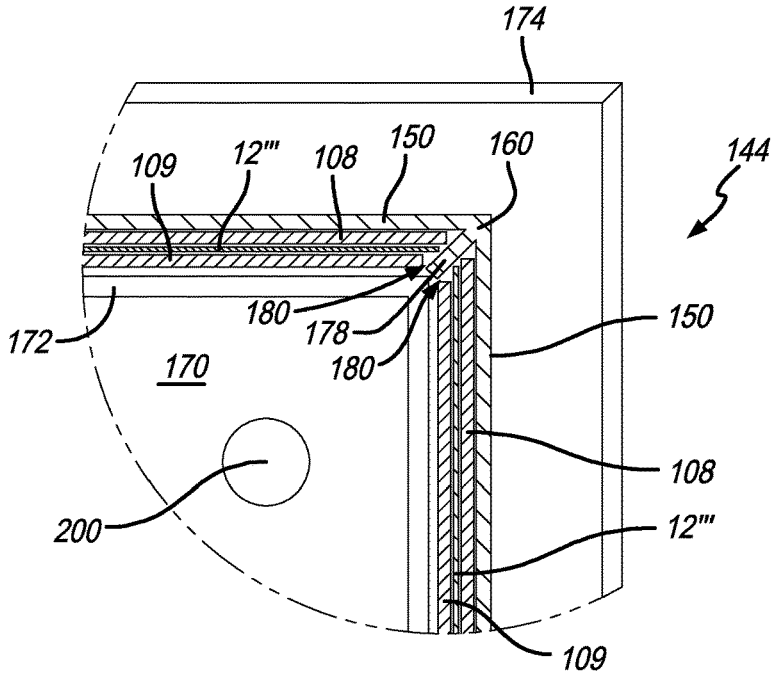
FIG. 37 is an enlarged cross-sectional view taken about the circle 37 in FIG. 36, further illustrating an upper lens tab retaining ends of a pair of the transparent outer lenses, a pair of the backlit films, and a pair of the transparent inner lenses, with a set of open frame sections.
Figure 38:
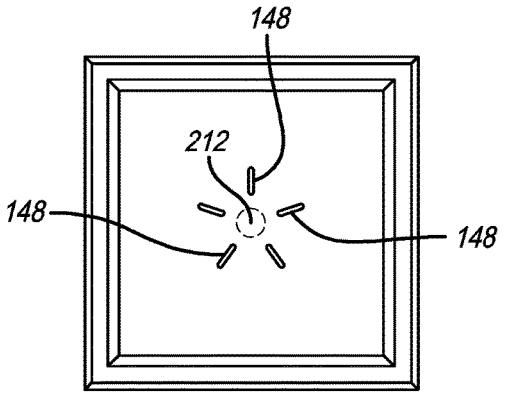
FIG. 38 is a top view of the rectangular backlit ornament of FIG. 33.

FIG. 36 is a cross-sectional view taken about the line 36-36 in FIG. 33 and more specifically illustrates the positioning of the external rectangular frame 146 relative to the transparent outer lenses 108, the backlit films 12''', and the transparent outer lenses 109, which generally encompass the internally located battery powered light 178. As shown in FIGS. 34 and 36, and in more detail in the enlarged cross-sectional view of FIG. 37, the external rectangular frame 146 may include a set of vertical lens tabs 178 that project inwardly from each of the upper rectangular corners 160. In this embodiment, the vertical lens tabs 178 are of generally uniform thickness and extend the distance between the upper horizontal frame members 152 and the lower horizontal frame members 166. This ensures that the vertical lens tabs 178 maximize surface area engagement along the height of the transparent outer lenses 108, the backlit films 12''' (in some embodiments), and/or the transparent inner lenses 109 (in some embodiments). Alternatively, the vertical lens tabs 178 may be discrete upper and/or lower lens tabs formed in each of the intersecting corners of the upper rectangular corners 160 and/or the lower rectangular corners 164.

The vertical lens tabs 178 may be configured for slide-fit engagement with the transparent outer lenses 108, the backlit films 12''', and/or the transparent inner lenses 109, as mentioned above. More specifically, the vertical lens tabs 178 may project inwardly at an angle (e.g., between 35 and 55 degrees) relative to the respective adjacent open frame sections 150 to form a pair of pinch points 180 therebetween (e.g., at each of the corners 160, 164), such as shown best in FIG. 36. When engaged with the external rectangular frame 146, each of the transparent outer lenses 108 may be positioned flush against a smooth inner surface of the respective open frame section 150 and subsequently retained in place by the vertical lens tabs 178 within the pinch points 180. Specifically, the outer corners and/or vertical edges of the transparent outer lenses 108 slide within the pinch points 180 in compression fit or pinched engagement between the vertical lens tabs 178 and the respective open frame section 150 (e.g., as best shown in the enlarged cross-sectional view of FIG. 37). The pinch points 180 may extend the vertical distance between the upper horizontal frame members 152 and the lower horizontal frame members 166. Likewise, each of the backlit films 12''' may subsequently be situated behind the respective transparent outer lenses 108 and retained in position by pinched engagement between the vertical lens tabs 178 and the respective open frame section 150. Substantially the entire area of the flat top surface of each backlit film 12''', which may be smooth itself, can be positioned flush against the smooth inner surface of each respective transparent outer lens 108 at least in part because the transparent outer lenses 108 do not include any corrugations. In this respect, the transparent outer lenses 108 are generally formed from a somewhat rigid or hard plastic material that prevents the transparent outer lenses 108 from deforming and thereby coming loose from their respective positions in the pinch points 180 between the respective open frame section 150 and the vertical lens tabs 178.

The external rectangular frame 146, the transparent outer lenses 108, the rectangular upper retainer cap 142, and the rectangular base 144 together form an enclosure forming the rectangular backlit ornament 140 with the backlit film 12''' secured therein adjacent the transparent outer lenses 108 and viewable out through the open frame sections 150.

In some embodiments, such as shown best in FIGS. 34-37, the transparent outer lenses 108 and the backlit films 12''' may be further retained in place by the respective transparent inner lenses 109 positioned between the flat bottom surface of the backlit films 12''' and the vertical lens tabs 178. Sandwiching the backlit films 12''' between the transparent outer lenses 108 and the transparent inner lenses 109 may help prevent movement of the backlit films 12''' should the rectangular backlit ornament 140 move after assembly. Additionally, securing the backlit films 12''' between the transparent outer lenses 108 and the transparent inner lenses 109 may obviate the need for the backlit films 12''' to engage with the respective vertical lens tabs 178, thereby allowing the backlit films 12''' to be sized in various shapes that do not require extension into the pinch points 180 (e.g., non-rectangular shapes such as a star or circle). Such an embodiment may also reduce wear on the backlit films 12''' by preventing rubbing against the vertical lens tabs 178. Here, the outer vertical edges of the transparent outer lenses 108 and/or the outer vertical edges of the transparent inner lenses 109 engage the respective vertical lens tabs 178. In this respect, the backlit films 12''' may be completely sandwiched between the transparent outer lenses 108 and the transparent inner lenses 109.

Figure 39:
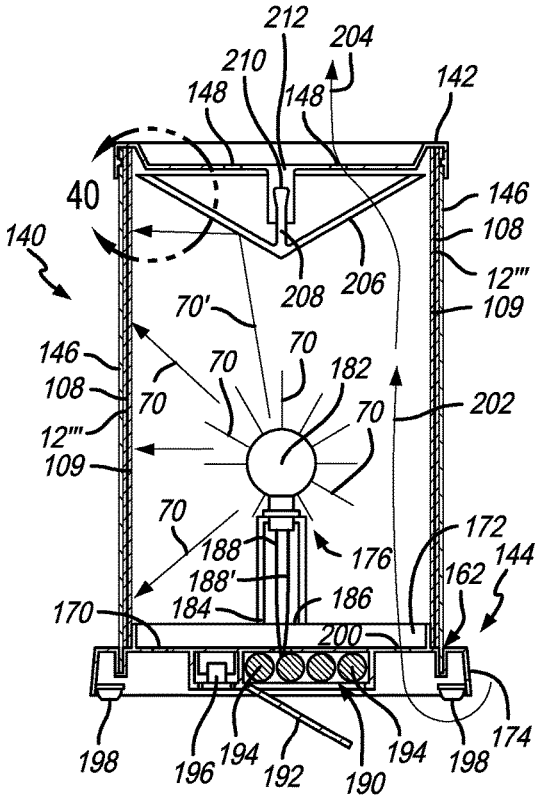
FIG. 39 is a cross-sectional view of the rectangular backlit ornament taken about the section plane 39-39 in FIG. 33, further illustrating a battery powered light engaged in non-rotatable relation relative to a rectangular base and elevated by a set of feet that facilitate convective air flow and cooling.

FIG. 39 is a cross-sectional view of the rectangular backlit ornament 140 more specifically illustrating internal placement of the battery powered light 176 within the enclosure formed by the external rectangular frame 146 with the rectangular upper retainer cap 142 and the rectangular base 144. The battery powered light 176 may include a bulb 182 that emits the plurality of light waves 70 into the interior of the rectangular backlit ornament 140 for illuminating the backlit images 12''' shown sandwiched between the transparent outer lenses 108 and the transparent inner lenses 109. The bulb 182 may be selectively attachable to a lamp post 184 that selectively engages in non-rotatable or rotatable relation with a lamp post socket 186 formed into the support surface 170 of the rectangular base 144. The lamp post 184 includes a pair of internal wires 188, 188' that couple to a battery chamber 190 also statically positioned relative to or otherwise formed from the rectangular base 144. The battery chamber 190 may be configured to enclose in non-removable or removable relation one or more rechargeable or non-rechargeable batteries. In the example embodiment disclosed in FIG. 39, the battery chamber 190 includes a lid 192 that may pivot relative to the rectangular base 144 to allow for the select insertion and/or removal of a plurality of AA batteries 194. An on/off switch 196 accessible from underneath the rectangular base 144 may be used to activate and/or deactivate energy from the AA batteries 194 through the wires 188, 188' and to the bulb 182 for illumination thereof.

FIG. 39 also more specifically illustrates the rectangular lower channel 162 formed into the support surface 170, along with the skirt 174 extending downwardly and outwardly away from the external rectangular frame 146. The downwardly and outwardly extending skirt 174 generally forms a recess up underneath the rectangular base 144, which accommodates the rectangular lower channel 162, the battery chamber 190, the AA batteries 194, the on/off switch 196, etc. Additionally, the rectangular backlit ornament 140 may include a plurality of support feet 198 (e.g., positioned at each of the lower rectangular corners 164) to elevate the rectangular base 144 above an underlying support surface to facilitate convection cooling. In this respect, for example, the support surface 170 may include multiple ventilation apertures 200 (FIGS. 36, 37, and 39) that permit airflow (e.g., as indicated by an arrow 202) through the rectangular base 144 and into the enclosure. The convection cooling is further illustrated by an arrow 204, which shows continued airflow out through one or more of the vents 148 in the rectangular upper retainer cap 142.

In this embodiment, the upper retainer cap 142 may also selectively couple to an optional upper pyramid reflector 206, which reduces light fall-off and serves as a baffle for the ventilation apertures. The upper pyramid reflector 206 may be similar to those reflectors described above, except that it may be configured to attach to the rectangular upper retainer cap 142 by virtue of the battery powered light 176 being coupled to the rectangular base 144. As shown in FIG. 39, the pyramid reflector 206 may include an upper extension 208 with a flared end 210 configured for snap-fit or press-fit engagement with a retaining slot 212 in the rectangular upper retainer cap 142. The inner diameter of the retaining slot 212 may be approximately the same diameter or somewhat smaller than the outer diameter of the flared end 210 of the upper extension 208 to facilitate compression fit engagement therewith. Once inserted, the upper pyramid reflector 206 remains affixed as the flared end 210 remains compressed within the retaining slot 212. Here, the upper pyramid reflector 206 is removably affixed to the rectangular upper retainer cap 142. Removal simply requires pulling the upper extension 208 out from within the retaining slot 212. Alternatively, the upper pyramid reflector 206 may be temporarily or permanently adhesively or mechanically attached (e.g., screwed or nailed) to the rectangular upper retainer cap 142. FIG. 39 illustrates the series of light waves 70 emitted from the bulb 182, and specifically a light wave 70' reflecting off the upper pyramid reflector 206 for redirection into the backlit films 12'''. The interior surface of the upper pyramid reflector 206 may also be made from or coated with a reflective material to help facilitate such reflection.

Figure 40:
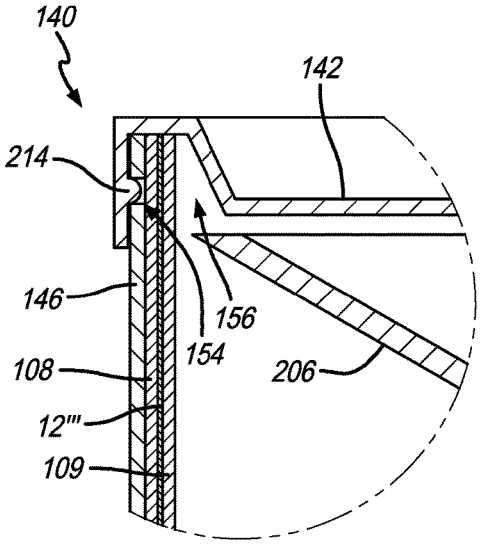
FIG. 40 is an enlarged cross-sectional view taken about the circle 40 in FIG. 39, further illustrating snap-fit reception of a rectangular upper retainer cap with the external rectangular frame.

FIG. 40 is an enlarged cross-sectional view of the rectangular backlit ornament 140, further illustrating engagement of the rectangular upper retainer cap 142 with the external rectangular frame 146. More specifically, FIG. 40 illustrates one of a plurality of upper engagement projections 214 extending into the rectangular upper channel 156 and into engagement with one of the connecting apertures 154 in one of the upper horizontal frame members 152 of the external rectangular frame 146. Here, the rectangular upper retainer cap 142 removably engages the external rectangular frame 146 by way of interconnection of one or more of the plurality of upper engagement projections 214 with the reciprocal connecting apertures 154. In this respect, multiple of the connecting apertures 154 may be disposed at intermittent intervals (e.g., equidistant intervals such as shown in FIG. 34) or at distinct locations (e.g., near the rectangular upper corners 160) in the external rectangular frame 146 and configured for slide-fit or snap-fit engagement with the corresponding upper engagement projections 214 disposed at similar intervals about the interior of the rectangular upper channel 156 of the rectangular upper retainer cap 142. Accordingly, each of the upper engagement projections 214 may engage the respective connecting apertures 154 to ensure the rectangular upper retainer cap 142 remains substantially affixed to the external rectangular frame 156. The rectangular upper retainer cap 142 may be made from a substantially resilient and lightweight plastic material that permits outward flexing of the rectangular upper channel 156. This allows for enlargement of the rectangular upper channel 156 to facilitate insertion of the external rectangular frame 146 therein, such that the upper engagement projections 214 may slidably insert into and engage the upper connecting apertures 154. Once engaged, the rectangular upper retainer cap 142 (e.g., made from the resilient plastic material) may retain its shape substantially as shown in FIG. 40. Here, the flat top surface of the backlit film 12''' is positioned flush against the smooth inner surface of the transparent outer lens 108 and the flat bottom surface of the backlit film 12''' is positioned flush against the smooth outer surface of the transparent inner lens 109.

The cross-sectional view of FIG. 40 also more specifically illustrates the relative positioning of the upper pyramid reflector 206 relative to the transparent inner lens 109 when the flared end 210 of the upper extension 208 is slidably engaged in compression fit engagement with the retaining slot 212. The upper pyramid reflector 206 generally extends outwardly into close proximity with the transparent inner lens 109 to facilitate a higher efficiency of light redirection on to the backlit image 12'''.

Likewise, lower connecting apertures 168 (FIG. 34) of the lower horizontal frame members 166 may be configured for slide-fit or snap fit engagement with engagement projections (e.g., similar to those shown with respect to FIG. 40) projecting inwardly into the rectangular lower channel 162 in the rectangular base 144. The rectangular base 144 can also be manufactured from a substantially resilient yet flexible plastic material that allows for enlargement of the rectangular lower channel 162 upon desired insertion of the external rectangular frame 146 therein. In this respect, the rectangular lower channel 162 may flex outwardly to accommodate insertion of the external rectangular frame 146 beyond the lower engagement projections for slide-fit or press-fit engagement with the corresponding lower connecting apertures 168. Once engaged, the substantially resilient plastic material recovers back to its shape as shown, e.g., in FIG. 34.

Figure 41:
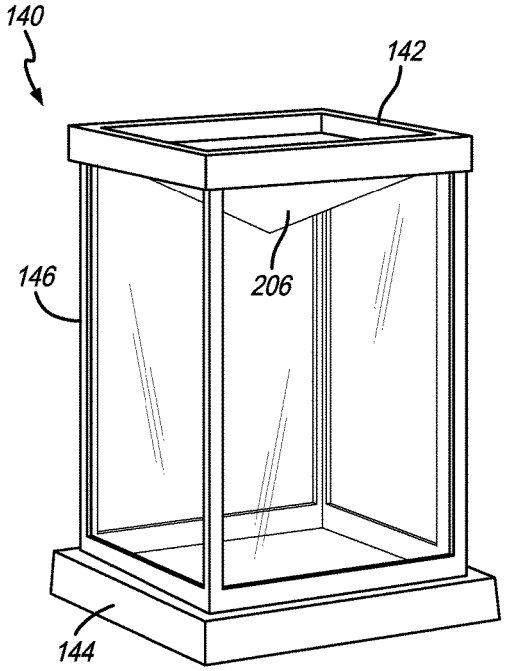
FIG. 41 is a perspective view of the rectangular backlit ornament of FIG. 33, as disclosed herein.

FIG. 41 is a perspective view of the rectangular backlit ornament 140 constructed into an upright enclosure by way of the rectangular upper retainer cap 142 and the rectangular base 144. In this embodiment, the external rectangular frame 146 is assembled with at least one of the transparent outer lenses 108 and/or the transparent inner lenses 109.

Figure 42:
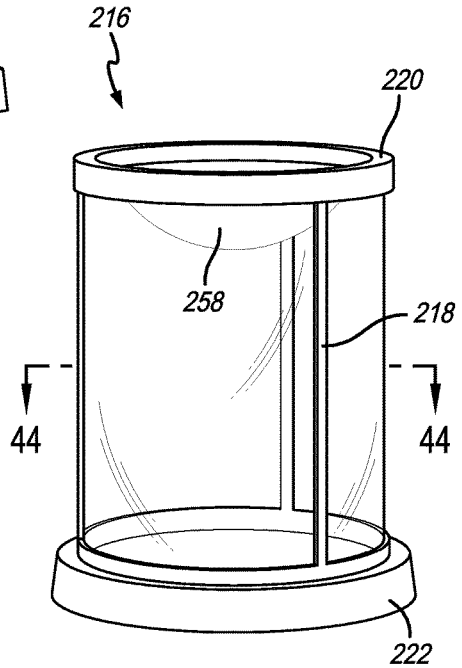
FIG. 42 is a perspective view of an alternative circular backlit ornament as disclosed herein.

In another embodiment as disclosed herein, FIGS. 42-45 illustrate an alternative circular backlit ornament 216. As shown in FIG. 42, the alternative circular backlit ornament 216 includes an external circular frame 218 that may selectively couple to a circular upper retainer cap 220 and may selectively or permanently couple to a circular base 222. When engaged together, the external circular frame 218, the circular retainer cap 220 and the circular base 222 form an upright enclosure that is the circular backlit ornament 216, in accordance with the embodiments disclosed herein.

Figure 43:
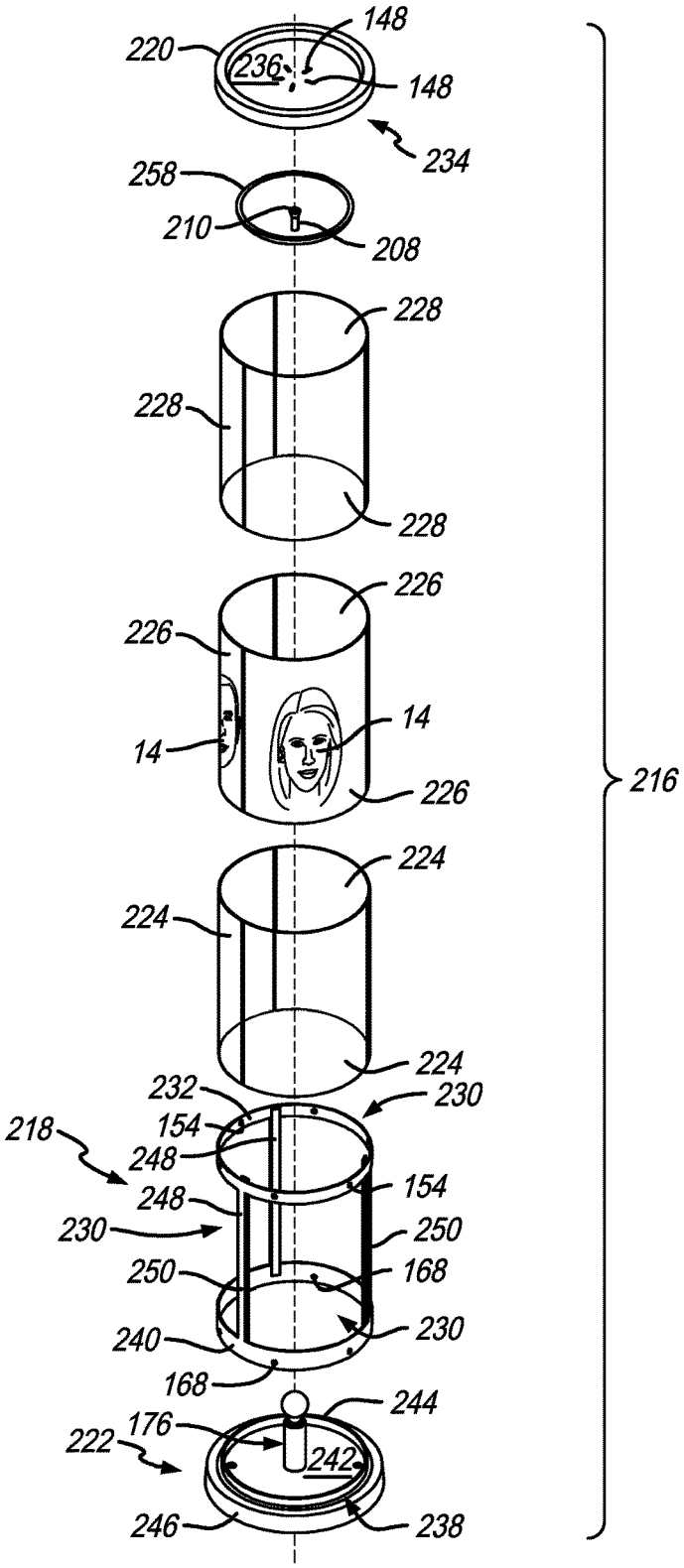
FIG. 43 is an exploded perspective view of the alternative circular backlit ornament of FIG. 42, further illustrating exploded arrangement of an external circular frame, a set of arced transparent outer lenses, a set of arced backlit films, and a set of arced transparent inner lens retained therein by an upper circular retainer cap and a lower circular base.

In this respect, the exploded perspective view of FIG. 43 more specifically illustrates the features of the alternative circular backlit ornament 216. As shown, the external circular frame 218 is in exploded relation relative to a series of arced transparent outer lenses 224, a series of arced backlit films 226 (two having the images 14 thereon), and a set of arced transparent inner lenses 228. The arced transparent outer lenses 224 are designed to cooperate with the arced transparent inner lenses 228 to encapsulate the arced backlit films 226 therein, to support the arced backlit films 226 in an upright position for viewing of the images 14 thereon. The arced backlit films 226 may be made from a hard material that generally tracks the arced contours of the arced transparent outer lenses 224 and the arced transparent inner lenses 228 for flush engagement therebetween. Alternatively, the arced backlit films 226 may be made from a flexible material that simply allows the arced backlit films 226 to form-fit to the curvature of the arced transparent outer lenses 224 and/or the arced transparent inner lenses 228. In this embodiment, the flexible arced backlit images 226 may be used with alternative circular backlit ornaments 216 that vary in diameter.

The external circular frame 218 may be generally formed from a somewhat rigid or hard plastic material configured to selectively support each of the arced transparent outer lenses 224, each of the arced backlit films 226, and each of the arced transparent inner lenses 228 in the upright position shown, e.g., in FIGS. 42 and 43. In the embodiments shown with respect to FIGS. 42-45, the external circular frame 216 includes a set of three generally arced open frame sections 230 that together form the circular structure of the external circular frame 218, as shown, e.g., in FIG. 43. Each of the arced open frame sections 230 form a frame or window that permits viewing of the arced backlit films 226 and the images 14 thereon when placed flush behind the arced transparent outer lenses 224 (e.g., as shown best in FIGS. 44-45).

Similar to the other embodiments disclosed herein, the external circular frame 218 includes an upper circular frame member 232 having a plurality of the upper connecting apertures 154 therein configured for select slide-fit or snap-fit engagement with a corresponding detent or protrusion (e.g., those shown with respect to FIG. 25 or FIG. 40) formed from or otherwise projecting into a circular upper channel 234 formed from the circular upper retainer cap 220. The circular upper channel 234 is generally formed up underneath a top surface 236 of the circular upper retainer cap 220, shown best in FIG. 43. The circular upper channel 234 may be of a size approximately the width of the upper circular frame member 232. Similarly, the circular base 222 may include a circular lower channel 238 having a size and shape for select slide-in reception of a lower circular frame member 240 having the lower connecting apertures 168 configured for snap-fit engagement with an inwardly projecting detent or protrusion (such as those described above) extending inwardly to the interior of the circular lower channel 238.

Figure 44:
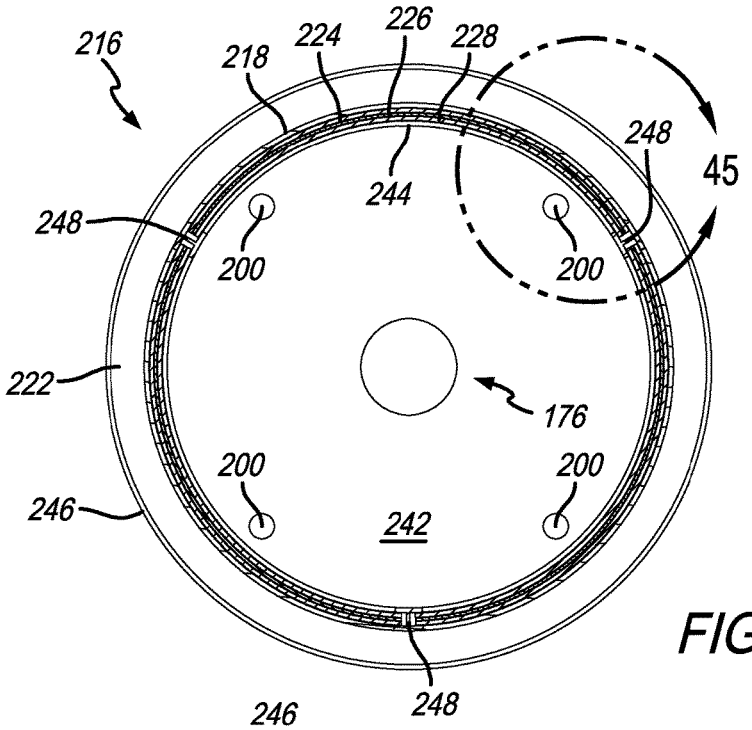
FIG. 44 is a cross-sectional view of the alternative circular backlit ornament taken about the section plane 44-44 in FIG. 42, further illustrating relative positioning of the external circular frame having a set of inwardly projecting lens retainers retaining therein the set of arced transparent outer lenses, the set of arced backlit films, and the set of arced transparent inner lens.
Figure 45:
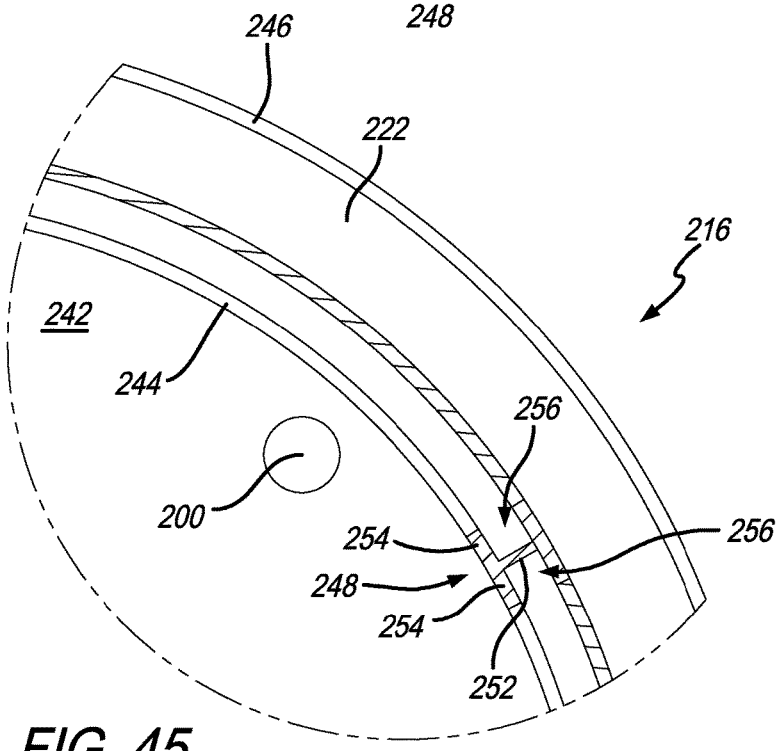
FIG. 45 is an enlarged cross-sectional view taken about the circle 45 in FIG. 44, further illustrating one of the inwardly projecting lens retainers retaining ends of a pair of the set of arced transparent outer lenses, a pair of the set of arced backlit films, and a pair of the set of arced transparent inner lens.

In this embodiment, and as best shown in FIGS. 43-45, the circular base 222 includes a generally inner horizontal support surface 242 having an upstanding circular lens tab 244 (e.g., formed integral with the circular base 222) positioned near an outer perimeter of the support surface 242, but to the interior of the circular lower channel 238. The circular lower channel 238 is formed into the support surface 242 outside of the upstanding circular lens tab 244 and the two cooperate together to provide interior and exterior stability to the external circular frame 218 when connected to the circular base 222. The exterior perimeter of the support surface 242 then extends downwardly around an outer perimeter into a circular skirt 246 that may provide additional stabilization for the circular backlit ornament 216 given that the circular skirt 246 terminates in an area relatively larger than the circular lower channel 238 that selectively receives and retains the external circular frame 218. Additionally, with respect to FIG. 43, the support surface 242 is shown supporting the battery powered light 176, as described herein.

FIG. 44 is a cross-sectional view taken about the line 44-44 in FIG. 42 and more specifically illustrates the positioning of the external circular frame 218 relative to the arced transparent outer lenses 224, the arced backlit films 226, and the arced transparent inner lenses 228, which generally encompass the internally located battery powered light 176. As shown in FIG. 44, and in more detail in the enlarged cross-sectional view of FIG. 45, the external circular frame 218 may include a set of "T"-shaped lens tabs 248 that project inwardly from a vertical connector 250 that creates the general framed structure of the external circular frame 218, along with the upper circular frame member 232 and the lower circular frame member 240. In one embodiment (e.g., as shown in FIG. 43), the T-shaped lens tabs 248 may generally track the vertical height of the vertical connectors 250, thereby generally extending between the upper circular frame member 232 and the lower circular frame member 240. Although, in alternative embodiments, the T-shaped lens tabs 248 may track only part of the vertical connectors 250 or may be placed intermittently along the height of the vertical connectors 250 (e.g., at or near the upper circular frame member 232 and/or at or near the lower circular frame member 240).

In some embodiments, the external circular frame 218 may include three of the T-shaped lens tabs 248 projecting inwardly from three of the vertical connectors 250, as shown in FIGS. 43-44. Although, in other embodiments, the external circular frame 218 may include as few as one T-shaped lens tab 248 corresponding with one vertical connector 250. As shown in FIGS. 43 and 44, each of the three T-shaped lens tabs 248 and the corresponding vertical connectors 250 are equidistantly spaced about the perimeter of the external circular frame 218. Each of the three arced transparent outer lenses 224, the three arced backlit films 226, and the three arced transparent inner lenses account for coverage of approximately 120 degrees each about the perimeter of the circular backlit ornament 218. The coverage is basically a factor of the number of T-shaped lens tabs 248 and the vertical connectors 250. For example, in an embodiment wherein the external circular frame 218 includes two of the T-shaped lens tabs 248 corresponding with two of the vertical connectors 250, each would account for approximately 180 degrees about the perimeter of the circular backlit ornament 218. In another embodiment wherein the external circular frame 218 includes six of the T-shaped lens tabs 248 corresponding with six of the vertical connectors 250, each would account for approximately 60 degrees about the perimeter of the circular backlit ornament 218. Although, of course, the vertical connectors 250 may not necessarily be equidistant from one another, wherein the coverage of each of the arced transparent outer lenses 224, each of the arced backlit films 226, and/or each of the arced transparent inner lenses may vary in coverage relative to one another.

The T-shaped lens tabs 248 are configured for slide-fit engagement with the arced transparent outer lenses 224, the arced backlit films 226, and/or the arced transparent inner lenses 228. As shown in more detail in FIG. 45, the T-shaped lens tabs 248 may project inwardly at approximately a right angle (i.e., perpendicular) from the vertical connectors 250 by way of a channel extension 252 that "T's" out into a pair of channel retainers 254. The channel extension 252 and the channel retainers 254 cooperate with the vertical connectors 250 to form a pair of channels 256. The distance between the vertical connectors 250 and the channel retainers 254 (i.e., approximately the length of the channel extension 252) is of a size and shape for flush reception and engagement of the arced transparent outer lenses 224, the arced backlit films 226, and/or the arced transparent inner lenses 228. For example, in one embodiment, the channels 256 may be of a size to selectively receive and retain the arced transparent outer lenses 224, the arced backlit films 226, and the arced transparent inner lenses 228. Here, the vertical outer edges of the arced transparent outer lenses 224 may sit flush along the length of the vertical connectors 250 while the inner vertical edges of the arced transparent inner lenses 228 may sit flush along the length of the channel retainer 254, with the arced backlit films 226 sandwiched in between. In this respect, the channels 256 are of a size and shape to accommodate approximately the thickness of the arced transparent outer lenses 224 and the arced transparent inner lenses 228. Of course, in other embodiments, one or more of a combination of the arced transparent outer lenses 224, the arced backlit films 226, and/or the arced transparent inner lenses 228 may be used to form the viewable perimeter of the alternative circular backlit ornament 216, and the channels 256 would be sized accordingly. Thus, when engaged with the external circular frame 218, each of the arced transparent outer lenses 224 may be positioned flush against a smooth inner surface of the respective arced open frame section 230 and subsequently retained in place by the T-shaped lens tabs 248.

In this respect, substantially the entire area of the non-corrugated top surface of each arced backlit film 226, which may be smooth itself, can be positioned flush against the smooth inner surface of each respective arced transparent outer lens 224, at least in part because the arced transparent outer lens 224 do not include any corrugations, and the entire area of the non-corrugated bottom surface of each arced backlit film 226, which may be smooth itself, can be positioned flush against the smooth outer surface of each respective arced transparent inner lens 228, at least in part because the arced transparent inner lens 228 do not include any corrugations. Accordingly, the curvature of the top surface of the backlit film 226 is preferably approximately the same as or can be shaped to be approximately the same as (when flexible) the curvature of the inner surface of the arced transparent outer lens 224; and the curvature of the bottom surface of the backlit film 226 is preferably approximately the same as or can be shaped to be approximately the same as (when flexible) the curvature of the outer surface of the arced transparent inner lens 228. Similarly, the curvature of the inner surface of the arced transparent outer lens 224 may be approximately the same as the curvature of the bottom surface of the backlit film 226 when the backlit film 226 is sufficiently thin to be encapsulated therebetween.

The perspective view of FIG. 42 and the corresponding exploded perspective view of FIG. 43 further illustrate the relative positioning of an upper hemispherical domed reflector 258 that includes the upper extension 208 and the related flared end 210 for connection to the circular upper retainer cap 220, similar to how the upper pyramid reflector 206 connects up underneath the rectangular upper retainer cap 142, i.e., slidably engageable in compression fit engagement with the retaining slot 212. The upper hemispherical domed reflector 258 generally encompasses the circular upper retainer cap 220 and is designed to reflect light back out over the arced backlit films 226, as opposed to allowing light to escape out through the top of the circular backlit ornament 216, as disclosed herein.

As described herein, the circular upper channel 234 of the circular upper retainer cap 220 and/or the circular lower channel 238 of the circular base 222 may include one or more engagement projections that selectively slide-fit or snap-fit engage the one or more connecting apertures 154 and/or the lower connecting apertures 168 formed from the external circular frame 218, as described herein. Alternatively, the external circular frame 218 may be configured to include the L-shaped slots 86, 88 described above with respect to FIGS. 14-16, whereby the circular upper channel 234 of the circular upper retainer cap 220 and/or the circular lower channel 238 of the circular base 222 may utilize one or more engagement projections therein to twist and lock into the external circular frame 218. FIG. 42 is a perspective view of the circular backlit ornament 216 constructed into an upright enclosure by way of the circular upper retainer cap 220 (e.g., including multiple of the ventilation apertures 148, as shown in FIG. 43) and the circular base 222.

Although several embodiments have been described in detail for purposes of illustration, various modifications may be made to each without departing from the scope and spirit of the invention. Accordingly, the invention is not to be limited, except as by the appended.

What is claimed is:

1. An ornament, comprising:

a substantially rigid and upright frame generally forming a plurality of open frame sections each having a smooth inner surface and framing a respective viewing region;

at least one transparent outer lens having a smooth outer surface and a smooth inner surface, the smooth outer surface being positioned flush against the smooth inner surface of one of the open frame sections;

at least one backlit film image having a flat top surface positioned flush against the smooth inner surface of the at least one transparent outer lens and substantially aligned within the framed viewing region of one of the open frame sections for viewing;

at least one transparent inner lens having a smooth outer surface configured for flush engagement with a flat bottom surface of the backlit film image; and at least one retainer cap configured to selectively receive and retain at least a portion of the frame to define an enclosure with the at least one backlit film image positioned therein and viewable within respective viewing region.

2. The ornament of claim 1, wherein the frame includes a set of lens tabs inwardly projecting between adjoining open frame sections.

3. The ornament of claim 1, including a substantially rigid and upright internal frame having a smooth outer surface configured for flush engagement with a flat bottom surface of the at least one transparent inner lens.

4. The ornament of claim 1, wherein the frame comprises a prismatic shape formed by interconnection of the plurality of open frame sections.

5. The ornament of claim 4, including a pyramid-shaped reflector coupled to the frame opposite the at least one retainer cap and positioned to reflect light from a light source onto the backlit film image.

6. The ornament of claim 5, wherein the pyramid-shaped reflector includes a baffle vent and an interior surface coated with a reflective material.

7. The ornament of claim 4, wherein the at least one retainer cap comprises a triangular shape.

8. The ornament of claim 1, wherein the at least one transparent outer lens comprises multiple transparent outer lenses, the at least one backlit film image comprises multiple backlit film images, and the at least one transparent inner lens comprises multiple transparent inner lenses, one for each for the plurality of open frame sections.

9. The ornament of claim 8, wherein each of the multiple transparent outer lenses interconnect into a transparent outer lens assembly and each of the multiple transparent inner lenses separately interconnect into a transparent inner lens assembly.

10. The ornament of claim 9, wherein the transparent inner lens assembly has a size and shape to selectively slide within the transparent outer lens assembly.

11. The ornament of claim 1, including a plug insertable into the at least one retainer cap in non-rotatable compression-fit engagement therewith.

12. The ornament of claim 11, including a light source positioned within the enclosure and associated with the plug, the light source being fixed in non-rotatable relation relative to the plug.

13. The ornament of claim 1, wherein the at least one retainer cap comprises an upper retainer cap and a lower retainer cap, each of which include a respective channel therein.

14. The ornament of claim 13, including a plurality of engagement projections within each of the channels in the upper and lower retainer caps, the projections configured for select engagement with a respective set of receptacles formed in the frame.

15. The ornament of claim 13, wherein at least one of the upper or lower retainer caps is permanently attached to the frame.

16. The ornament of claim 13, wherein at least one of the upper or lower retainer caps is integrally formed with the frame.

17. An ornament, comprising:

a substantially rigid and upright frame generally including a plurality of open frame sections each having a smooth inner surface and framing a respective viewing region;

at least one backlit film image having a flat top surface capable of being positioned flush against the smooth inner surface of one of the plurality of open frame sections;

a set of lens tabs inwardly projecting between adjoining open frame sections and including at least one pinch point therein for positioning the at least one backlit film image in a position viewable within the respective viewing region; and at least one cap configured for select engagement with at least a portion of the frame to define an enclosure with the at least one backlit film image positioned therein.

18. The ornament of claim 17, wherein the set of lens tabs comprise at least two upper lens tabs and at least two lower lens tabs.

19. The ornament of claim 18, including a respective vertical lens tab positioned between a respective one of the at least two upper lens tabs and one of the at least two lower lens tabs.

20. The ornament of claim 19, wherein the upper and lower lens tabs project inwardly a relatively greater distance than the vertical lens tabs.

21. The ornament of claim 17, including at least one transparent outer lens having a smooth outer surface and a smooth inner surface, the smooth outer surface being positioned flush against the smooth inner surface of one of the open frame sections and the smooth inner surface being positioned flush and co-planar with the flat top surface of the at least one backlit film image.

22. The ornament of claim 21, wherein at least a portion of a vertical edge of the at least one transparent outer lens engages within the at least one pinch point in compression-fit engagement therein.

23. The ornament of claim 21, wherein at least a portion of a vertical edge of the backlit film image resides in compression-fit engagement between one of the inwardly projecting lens tabs and the transparent outer lens.

24. The ornament of claim 21, including at least one transparent inner lens having a smooth outer surface configured for flush engagement with a flat bottom surface of the backlit film image and positioned within the pinch point to suspend the backlit film image therein in sandwiched relationship with the at least one transparent outer lens.

25. The ornament of claim 24, wherein the backlit film image comprises a shape different than the shape of the at least one transparent outer lens or the at least one transparent inner lens.

26. The ornament of claim 17, including multiple of the at least one transparent outer lenses connected together forming an outer lens assembly and including multiple of the at least one transparent inner lenses connected together forming an inner lens assembly, the outer lens assembly having a size and shape to encompass the inner lens assembly.

27. The ornament of claim 17, wherein each of the lens tabs form an angle between 20 and 40 degrees relative to the respective open frame section.

28. The ornament of claim 17, wherein each of the lens tabs form an angle between 35 and 55 degrees relative to the respective open frame section.

29. The ornament of claim 17, wherein the frame comprises a prismatic shape formed by interconnection of the plurality of open frame sections.

30. The ornament of claim 17, including a pyramid-shaped reflector extending inwardly into the frame and generally positioned opposite the at least one cap, the reflector having a baffle vent and an interior surface coated with a reflective material that reflects light from a light source onto the backlit film image.

31. The ornament of claim 17, including a plug insertable into the at least one cap in non-rotatable compression-fit engagement therewith.

32. The ornament of claim 17, wherein the at least one cap comprises an upper cap and a lower cap, each having a respective channel with a plurality of projections therein for engaging a reciprocal plurality of engagement receptacles in the frame.

* * * * *